US005645361A

United States Patent [19]

Mitsushima et al.

[11] Patent Number: 5,645,361

[45] Date of Patent: Jul. 8, 1997

[54] THERMAL-TRANSFER-TYPE COLOR PRINTER HAVING A FEED ROLLER WITH MICRO PROJECTIONS

[75] Inventors: Susumu Mitsushima; Hayami Sugiyama; Hitoshi Nakagawa; Hiromitsu Ogita; Minoru Yamakuni; Kenichi Kawahara; Shigeyuki Kawamura; Kazuhiro Tsuji, all of Ise, Japan

[73] Assignee: Shinko Electric Co., Ltd., Tokyo, Japan

[21] Appl. No.: 643,403

[22] Filed: May 6, 1996

Related U.S. Application Data

[63] Continuation of Ser. No. 296,104, Aug. 25, 1994, abandoned.

[30] Foreign Application Priority Data

| | | | |
|---|---|---|---|
| Aug. 31, 1993 | [JP] | Japan | 5-216778 |
| Sep. 7, 1993 | [JP] | Japan | 5-222663 |
| Sep. 22, 1993 | [JP] | Japan | 5-051590 |
| Sep. 27, 1993 | [JP] | Japan | 5-052169 |
| Jan. 10, 1994 | [JP] | Japan | 6-000956 |
| Jan. 20, 1994 | [JP] | Japan | 6-004886 |

[51] Int. Cl.[6] ..... G41J 13/076

[52] U.S. Cl. ..... 400/636; 400/634; 226/193

[58] Field of Search ..... 408/634, 635, 408/636, 617; 226/193, 188, 191; 346/68, 129, 136, 139 R

[56] References Cited

U.S. PATENT DOCUMENTS

| | | | |
|---|---|---|---|
| 2,052,566 | 9/1936 | Haines . | |
| 4,532,525 | 7/1985 | Takahashi | 400/636 |
| 4,683,480 | 7/1987 | Sakamoto et al. | 400/636 |
| 4,889,271 | 12/1989 | Kurokawa | 226/191 |
| 4,903,045 | 2/1990 | Sakamoto et al. | 226/183 |
| 4,917,283 | 4/1990 | Weatherhead et al. | 226/191 |
| 5,099,759 | 3/1992 | Sonobe et al. | 101/348 |
| 5,124,724 | 6/1992 | Hatakeyama et al. . | |
| 5,182,861 | 2/1993 | Suzuki et al. | 400/636.1 |
| 5,193,800 | 3/1993 | Kashiwabara | 271/272 |

FOREIGN PATENT DOCUMENTS

| | | |
|---|---|---|
| 38 02 735 | 1/1988 | Germany . |
| A61291160 | 12/1986 | Japan . |
| A02067163 | 3/1990 | Japan . |

*Primary Examiner*—John S. Hilten
*Attorney, Agent, or Firm*—Darby & Darby

[57] ABSTRACT

In a thermal-transfer-type color printer, an ink ribbon and a paper are sandwiched between a thermal head and a platen roller so that a specific image is transferred onto the paper in a specific color. The platen roller is made by a rubber material which has a certain degree of hardness. On the surface of the ink ribbon, plural colors of ink are sequentially and repeatedly painted. Hence, after transferring an image onto the paper in one color, the paper is moved backward; and then, another image is transferred onto the paper in another color. Thus, a multi-color printing is performed. In order to avoid a color shade or an printing error, in which a printing position of one-color image does not accurately match with a printing position of another-color image, the paper should be accurately moved forward and backward. In order to do so, the thermal-transfer-type color printer provides a precise paper-feed mechanism which comprises a pinch roller and a paper-feed roller. Around a surface of the paper-feed roller, micro projections are formed in predetermined size and shape, so that the paper is certainly held between the pinch roller and paper-feed roller. The micro projections can be formed at a selected surface area of the paper-feed roller. Those micro projections are formed by carrying out an etching process using a masking pattern formed at a certain surface area of the paper-feed roller.

8 Claims, 18 Drawing Sheets

THERMAL-TRANSFER-TYPE COLOR PRINTER HAVING A FEED ROLLER WITH MICRO PROJECTIONS

This is a continuation of application Ser. No. 08/296,104, filed Aug. 25, 1994 now abandoned.

BACKGROUND OF THE INVENTION

1. Field of the Invention

The present invention relates to a thermal-transfer-type color printer which transfers colored images onto a paper by using an ink ribbon.

2. Prior Art

FIG. 1 is a drawing simply illustrating an example of a mechanical structure of a thermal-transfer-type color printer conventionally known. In FIG. 1, an ink ribbon 2, which has not been used yet, is wound around a ribbon-supply roller 1. The overall area of the ink ribbon 2 is divided into a plenty of areas in a longitudinal direction, wherein each of those areas is painted with ink having a specific color. For example, three colors (i.e., yellow color, magenta color and cyan color) of ink are sequentially and repeatedly painted on the ink ribbon 2; or four colors (i.e., yellow color, magenta color, cyan color and black color) of ink are sequentially and repeatedly painted on the ink ribbon 2.

The ink ribbon 2, supplied from the ribbon-supply roller 1, is led to a place between a thermal head 4 and a platen roller 5 by means of a guide roller 3B. A paper 6 is wound around the platen roller 5, so that the ink ribbon 2 comes in contact with the paper 6. The ink, painted on the ink ribbon 2, is melted by heat, applied by the thermal head 4, so that a specific image is transferred onto the paper 6 with a specific color. After a printing is performed, the ink ribbon 2 turns to a used ink ribbon 7, which is then led to a ribbon-winding roller 9 by means of a guide roller 8. Thus, the used ink ribbon 7 is wound up around the ribbon-winding roller 9.

The platen roller 5 is made by rubber materials and the like. This platen roller 5 is sandwiched between pinch rollers 10 and 11.

When transferring one-color ink (e.g., yellow-color ink) onto the paper 6, the platen roller 5 is driven to rotate in a forward direction. In this case, the paper 6 is held between the platen roller 5 and the pinch rollers 10, 11 which are pressed with each other; and the paper 6 is transported in a direction "m". At the same time, the ink ribbon 2, supplied from the ribbon-supply roller 1, is led to the place between the thermal head 4 and the platen roller 5 by means of the guide roller 3; and then, the used ink ribbon 7 is led to the ribbon-winding roller 9 by means of the guide roller 8 and is wound up.

In addition, the thermal head 4 is driven to move in a direction "p" by a spring (not shown), so that the thermal head 4 is pressed against the ink ribbon 2. In synchronism with a speed of carrying the ink ribbon 2 and the paper 6, heating elements of the thermal head 4 are heated in response to print data such as character data and image data. Under the effects of the heat and pressure, a specific image is transferred onto the paper 6 by one-color ink (e.g., yellow-color ink) while the paper 6 is held between the thermal head 4 and the platen roller 5. Next, in order to transfer the another-color image by using another-color ink (e.g., magenta-color ink) such that the magenta-color image overlaps with the yellow-color image, a preparation stage is made. In the preparation stage, the platen roller 5 is driven to rotate backward, so that the paper 6 is carried in a direction "n". At this stage, the thermal head 4 is rotably moved in a direction "q", while the ink ribbon 2 is wound up by the ribbon-winding roller 9 so that the ink ribbon 2 does not come in contact with the paper 6.

The above-mentioned operations are performed with respect to each of three colors of ink or each of four colors of ink. As a result, characters, images and the like are printed in a multi-colored manner on a single paper 6.

As described above, the thermal-transfer-type color printer is designed such that three colors of ink or four colors of ink are sequentially melt and transferred on a single paper 6. Hence, if a printing position of one-color image does not accurately match with a printing position of another-color image, there occurs a drawback that a desired color printing, corresponding to the print data inputted, cannot be obtained. In the worst case, a precision of the color printing is so poor that the printed characters cannot be clearly read by a person.

In order to avoid the above drawback, it is demanded that a precision of overlapping the print dots among the plural colors of ink should be sufficiently high. In the thermal-transfer-type color printer, the thermal head 4 is normally set in a certain positional state, while the ink ribbon 2 and the paper 6 are carried in a desired direction. Hence, it is demanded to improve the precision of carrying the ink ribbon 2 and the paper 6, particularly, the precision of carrying the paper 6.

In order to achieve the above-mentioned demands, it is necessary that the mutual pressure should be uniformly applied between the platen roller 5 and the pinch rollers 10, 11. In that sense, the rubber, which is used for the platen roller 5, should have a certain degree of hardness or more.

The thermal head 4 has a length which corresponds to the width of the paper (e.g., A3-size paper or A4-size paper). In other words, the thermal head 4 has a line of heating elements; thus, it is possible to simultaneously print one line of print data on the paper. Therefore, it is an essential condition that the uniform pressure should be imparted between the thermal head 4 and the platen roller 5 in the overall length. If such condition is not satisfied, the plural colors of ink cannot be certainly transferred onto the paper 6 without causing the color shade or drop-out errors in the printing.

Meanwhile, there is a limit in the degree of flatness of the heating elements of the thermal head 4 because of the manufacturing process. Further, in order to reduce the size of the thermal-transfer-type color printer, the diameter of the platen roller 5 cannot be increased so much. Therefore, when the thermal head 4 is pressed against the platen roller 5, a small deflection may be occurred on the platen roller 5.

The above-mentioned facts indicate that the rubber, used for the platen roller 5, should have a certain degree of flexibility.

As described above, the contradictory characteristics should be required for the rubber material, used for the platen roller 5. Conventionally, the degree of hardness of the rubber is set at 50°. However, such degree of hardness cannot offer a good precision of overlapping the print dots among the plural colors of ink and a satisfactory thermal-transfer performance in the color printing. This disadvantage depends upon the complex functions of the platen roller 5. In the conventional printer, the platen roller 5 has a function to carry the paper 6 as well as a function to act as a support body to which the thermal head 4 is pressed in the thermal-transfer mode.

Another thermal-transfer-type color printer is provided to eliminate the above-mentioned disadvantage. This printer provides two rollers, wherein one roller is provided to perform the function to carry the paper and another roller is provided to perform the function to support the thermal head. FIG. 2 is a drawing simply illustrating a mechanical structure of this printer. In FIG. 2, the parts identical to those shown in FIG. 1 are designated by the same numerals; hence, the description thereof will be omitted. In the thermal-transfer-type color printer shown in FIG. 2, a set of the platen roller 5 and the pinch rollers 10, 11 shown in FIG. 1 is replaced by a set of a platen roller 12, paper-feed rollers 13, 14 and pinch rollers 15, 16.

The platen roller 12 is made by the rubber material which is optimum to the thermal-transfer-type printing. The degree of hardness is set around 40°, for example, which is the optimum degree of hardness for the thermal-transfer-type printing. This platen roller 12 is not driven in the thermal-transfer mode using the color ink. The paper-feed roller 13 is made by the rubber and the like. Another paper-feed roller 13 is called an elusion roller. A base portion of the paper-feed roller 13 is made by the stainless steel. Particles, which are made by a certain material like Ni-Cr material and each of which has a diameter of 20–60 μm, are sprayed on an outer peripheral face of the paper-feed roller 14; thus, micro projections (not shown) are formed on the surface of the paper-feed roller 14.

In the thermal-transfer mode, using one color ink (e.g., yellow-color ink), of the printer shown in FIG. 2, the paper-feed roller 14 is driven to rotate forward, whereas both of the platen roller 12 and the paper-feed roller 13 are not driven. Hence, these rollers 12 and 13 act like a load to the paper-feed roller 14. Therefore, the paper 6 is carried in a direction "x" while being held between the paper-feed roller 14 and the pinch roller 16 which are pressed with each other. The ink ribbon 2, supplied from the ribbon-supply roller 1, is led to a place between the thermal head 4 and the platen roller 12 by means of the guide roller 3; and then, the used ink ribbon 7 is led to the ribbon-winding roller 9 by means of the guide roller 8 and is wound up.

The thermal head 4 is moved in the direction "p" under the effect of the spring (not shown) and is pressed against the platen roller 12. In synchronism with the speed of carrying the ink ribbon 2 and the paper 6, the heating elements of the thermal head 4 are heated in accordance with the print data such as the character data and image data. Under the effects of the heat and pressure, one-color ink (e.g., yellow-color ink) is melt and transferred onto the paper 6, which is held between the thermal head 4 and the platen roller 12.

In the printer shown in FIG. 2, the degree of hardness for the platen roller 12 is set at 40°, which is smaller (i.e., softer) than the degree of hardness employed by the printer shown in FIG. 1. Thus, it is possible to impart the uniform pressure between the thermal head 4 and the platen roller 12 along its overall length in the thermal-transfer mode. Therefore, the thermal-transfer performance can be improved.

In addition, the micro projections are formed on the peripheral surface of the paper-feed roller 14. Therefore, as compared to the platen roller 5 shown in FIG. 1, the paper-feed roller 14 has a larger coefficient of friction. In other words, the performance of feeding the paper can be improved.

By the way, the micro projections formed on the peripheral surface of the paper-feed roller 14 are not formed uniformly because of the manufacturing process. In other words, those micro projections are not uniform in size and arrangement. Due to the ununiformity, the pressure mutually applied between the paper-feed roller 14 and the pinch roller 16 cannot be made uniform along an overall length of the roller 14. Further, the platen roller 12 and the paper-feed roller 13 are not driven during the printing; in other words, those rollers act like the load to the paper-feed roller 14. This load may cancel an improvement in the performance of feeding the paper which is once improved by increasing the coefficient of friction.

Thus, as the plural colors of ink are transferred onto the paper, the printing positions are shifted such that the printing position of one-color ink may not accurately match with the printing position of another-color ink. Therefore, even in the printer shown in FIG. 2, the precision of overlapping the print dots among the plural colors of ink cannot be improved so much as compared to the foregoing printer shown in FIG. 1.

In the printing mode of the thermal-transfer-type color printer described above, the paper-feed roller 14 is driven to rotate forward, while the platen roller 12 and the paper-feed roller 13 are not driven so that those rollers may freely rotate in accordance with the feeding operation of the paper 6. Thus, in the printing mode, one edge of the paper 6 is drawn in the direction "x" by the roller 14, whereas another edge of the paper 6 is not drawn back in a direction opposite to the direction "x". In other words, a tension is not applied to the paper 6. For this reason, the paper 6 may be easily deflected between the roller 14 and the platen roller 12.

In general, the operations of the thermal-transfer-type color printer may be affected by the following fluctuating factors ① to ③.

① The roller 13 is not balanced with the platen roller 12 in terms of a degree of cylindrical shape.

② The pinch roller 15 is not balanced with the roller 13 in terms of a pressing load.

③ The thermal head 4 is not balanced with the platen roller 12 in terms of a pressing load.

Due to the above-mentioned fluctuating factors, the deflection of the paper 6 may be occurred or an attitude of the paper 6 is inclined so that the paper-feeding operation cannot be made in a desired direction. Thus, the carried position of the paper 6 does not accurately match with a desired position, which raises a problem that the precision of overlapping the print dots among the plural colors of ink becomes lower.

SUMMARY OF THE INVENTION

It is an object of the present invention to provide a thermal-transfer-type color printer which has an improved precision of overlapping the print dots among the plural colors of ink and which also has an improved thermal-transfer performance in the color printing.

The thermal-transfer-type color printer according to the present invention provides a precise paper-feed mechanism in order to avoid a color shade or an printing error in which a printing position of one-color image does not accurately match with a printing position of another-color image. Under operations of the paper-feed mechanism at least comprising the paper-feed roller and pinch roller, the paper can be accurately moved forward and backward. Around a surface of the paper-feed roller, micro projections are formed in predetermined size and shape, so that the paper is certainly held between the pinch roller and paper-feed roller. The micro projections can be formed at a selected surface area of the paper-feed roller which comes in contact with the pinch roller during a printing mode. Those micro projections are formed by carrying out an etching process using a masking pattern formed at a certain surface area of the paper-feed roller.

Particularly, the shape and size of the micro projection and the density of the micro projections to be formed in a unit area are determined on the basis of the results of the tests for evaluating the paper-feed characteristics of the paper-feed roller.

BRIEF DESCRIPTION OF THE DRAWINGS

Further objects and advantages of the present invention will be apparent from the following description, reference being had to the accompanying drawings wherein the preferred embodiments of the present invention are clearly shown.

In the drawings.

DESCRIPTION OF THE PREFERRED EMBODIMENTS

Now, preferred embodiments of the present invention will be described with reference to the drawings.

[A] First embodiment

Figure 1:
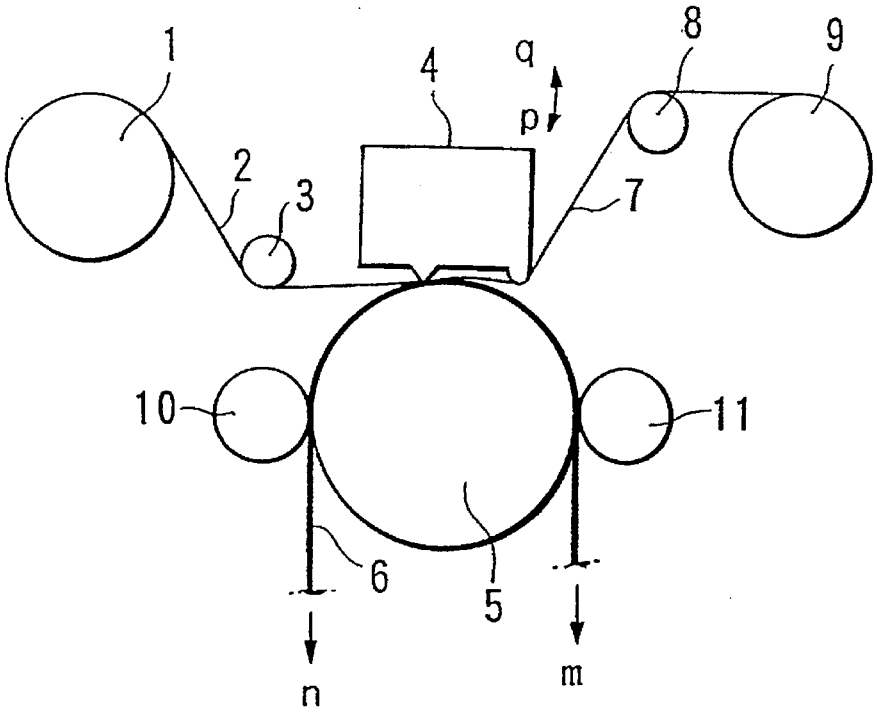
FIG. 1 (PRIOR ART)
FIG. 1 is a drawing simply illustrating a mechanical structure of an example of the thermal-transfer-type color printer conventionally known.
Figure 2:
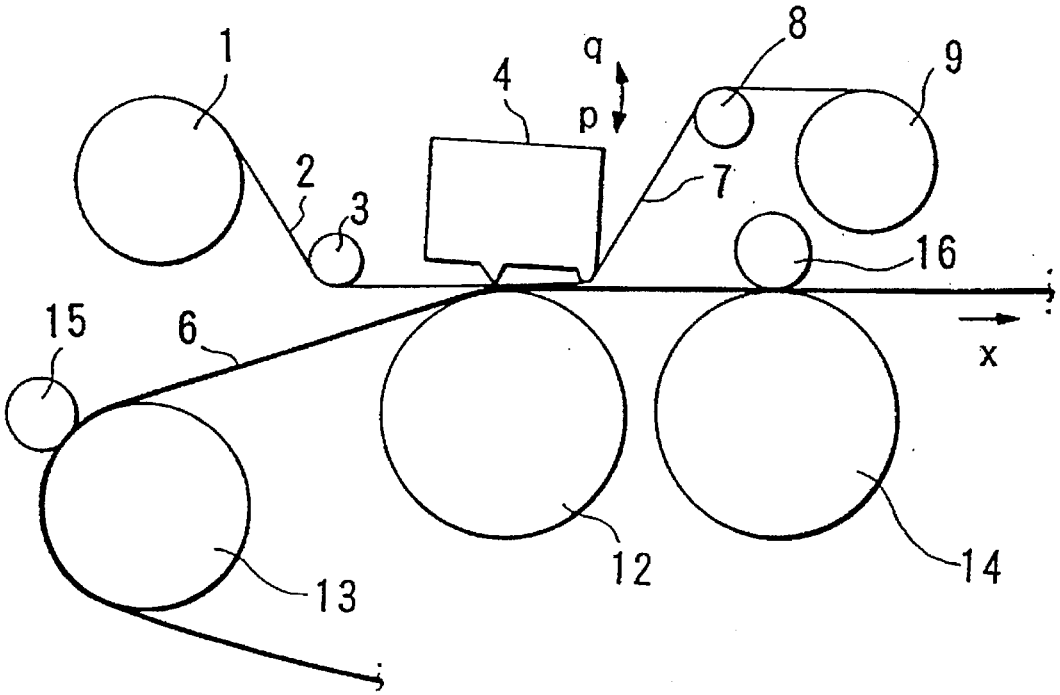
FIG. 2 (PRIOR ART)
FIG. 2 is a drawing simply illustrating a mechanical structure of another example of the thermal-transfer-type color printer conventionally known.
Figure 3:
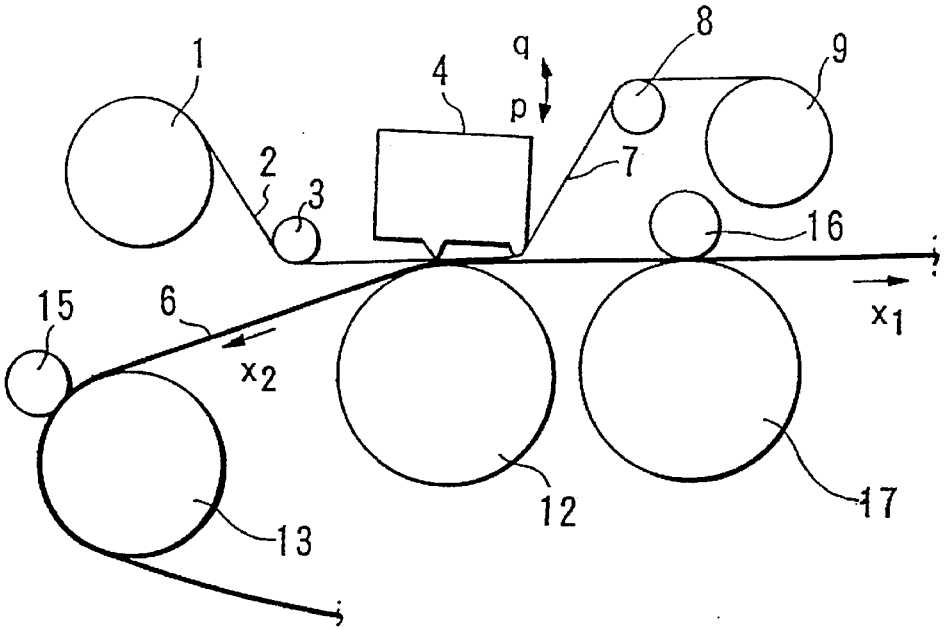
FIG. 3 is a drawing simply illustrating a mechanical structure of a thermal-transfer-type color printer according to a first embodiment of the present invention.

FIG. 3 is a drawing simply illustrating a mechanical structure of a thermal-transfer-type color printer according to a first embodiment of the present invention. In FIG. 3, the parts identical to those shown in FIGS. 1 and 2 will be designated by the same numerals; hence, the description thereof will be omitted. As compared to the printer shown in FIG. 2, the printer shown in FIG. 3 is characterized by providing a grip roller 17 which is provided instead of the paper-feed roller 14. The grip roller 17 is driven by a pulse motor (not shown).

Figure 4A:
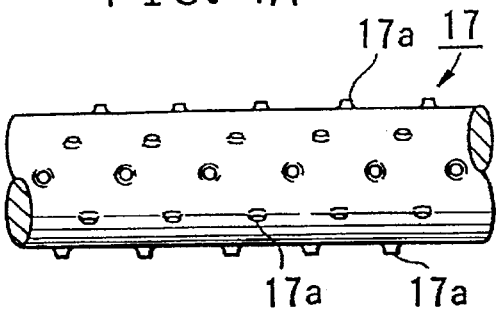
FIG. 4A shows an appearance of a grip roller.
Figure 4B:
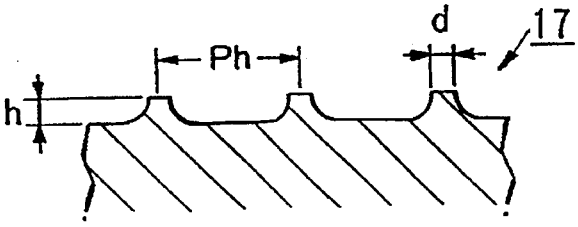
FIG. 4B shows a part of the grip roller.

FIG. 4A shows an appearance of the grip roller 17, while FIG. 4B shows a part of the grip roller 17. The grip roller 17 is manufactured by a cylinder made of carbon steel. Around an outer peripheral surface of the grip roller 17, micro projections 17*a* are regularly formed. Two micro projections are located apart from each other by a distance 'ph' (which is set at 700 μm or the like); each micro projection has a height 'h' (which is set at 50 μm or the like); and each micro projection has a diameter 'd', at its top portion, (which is set at 20 μm or the like).

The grip roller 17 is manufactured by a sequence of processes, which will be described below.

At first, a resist film, made of resin material, is formed around an overall peripheral surface of the carbon-steel cylinder; and then, a mask is placed on an upper surface of the resist film. In the mask, a plurality of holes, which are located in response to the micro projections 17*a*, are formed. Next, light is radiated to the mask to expose the resist film. Thereafter, an etching process is performed so that the masked area is only removed. Thus, the micro projections 17*a* are formed. Then, in order to improve the abrasion resistance, chrome plating is effected on the surface of the grip roller 17.

Now, when transferring one color ink (e.g., yellow-color ink) onto the paper 6, the grip roller 17 is driven to rotate forward by the pulse motor (not shown). In this case, however, the platen roller 12 and the paper-feed roller 13 are not driven, so that those rollers naturally rotate in accordance with the movement of the paper 6. In other words, those rollers act like the load to the grip roller 17. In the thermal-transfer mode, the paper 6 is certainly held by the pressure applied between the grip roller 17 and the pinch roller 16 and is carried in a direction "x1" (see FIG. 3). In addition, the ink ribbon 2, supplied from the ribbon-supply roller 1, is led to the place between the thermal head 4 and the platen roller 12 by means of the guide roller 3; and then, the used ink ribbon 7 is led to the ribbon-winding roller 9 by means of the guide roller 8 and is wound up. While the paper 6 is carried by the grip roller 17, a plurality of recesses 6*b* should be formed at a back face 6*a* of the paper 6 by the micro projections 17*a* which are formed around the overall peripheral surface of the grip roller 17 shown in FIG. 5. Those recesses 6*b* act as reference points for feeding the paper 6, which will be described later.

In the thermal-transfer mode, the thermal head 4 is moved in the direction "p" and is pressed against the platen roller 12 by the spring (not shown). In synchronism with the speed of carrying the ink ribbon 2 and the paper 6, the heating elements of the thermal head 4 are heated in response to the print data such as the character data and image data. Thus, under the effects of the heat and pressure, one-color ink (e.g., yellow-color ink) is melt and transferred onto the paper 6 which is held between the thermal head 4 and the platen roller 12. In the present embodiment, the platen roller 12 has a certain degree of hardness which is set at 40°. Due to such degree of hardness, the thermal head 4 can be uniformly pressed against the platen roller 12 along its overall length.

Figure 5:
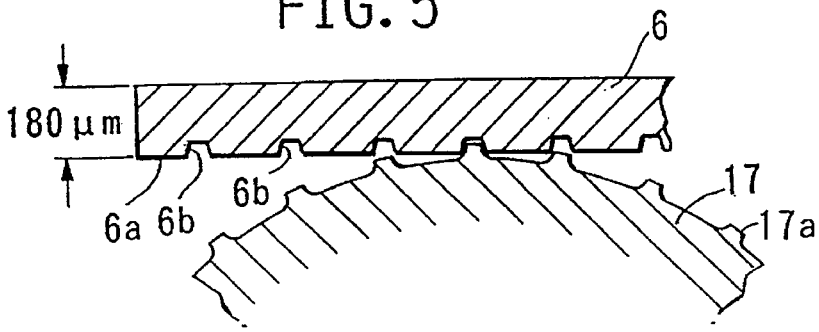
FIG. 5 is a conceptual drawing for explaining an engaging manner between the grip roller and the paper.

Before transferring another-color ink (e.g., magenta-color ink) onto the paper 6, a preparation should be made. In the preparation stage, all of the paper-feed roller 13, the platen roller 12 and the grip roller 17 are driven to rotate backward, so that the paper 6 is carried in a direction "x2" (see FIG. 3). In this stage, the thermal head 4 is rotably moved in the direction "q", while the ink ribbon 2 is wound up by the ribbon-winding roller 9; hence, the thermal head 4 does not come in contact with the paper 6. In the former thermal-transfer mode, the recesses 6*b* are formed at the back face 6*a* of the paper 6 as shown in FIG. 5. Thus, while the paper 6 is carrying back, the micro projections 17*a*, which are formed on the overall peripheral surface of the grip roller 17, are engaging with the recesses 6*b* as if the gear engages with the rack.

After the paper 6 is completely carried back to its original position, the printing of another-color ink is performed. Thereafter, other colors of ink (e.g., cyan-color ink and black-color ink) are sequentially transferred onto the paper 6. By overlapping those colors of ink, desired characters and/or images are printed on a single paper 6 in a multi-colored manner.

As described heretofore, when transferring one-color ink, the recesses 6*b* are formed on the back face 6*a* of the paper 6 by the micro projections 17*a* of the grip roller 17. The first embodiment positively utilizes those recesses 6*b* when carrying back the paper 6 and when transferring another-color ink. Since the micro projections 17*a* of the grip roller 17 precisely engage with the recesses 6*b* of the paper 6, the precision of feeding the paper 6 is improved. Therefore, the precision of overlapping the print dots among the plural colors of ink can be also improved. Thus, it is possible to obtain desired coloring which corresponds to the print data. So, the same color printing can be performed on a plurality of papers as long as the same print data is used.

Further, the optimum degree of hardness and the optimum material are selected for the platen roller 12; hence, it is possible to realize the uniform pressure applied between the thermal head 4 and the platen roller 12 along its overall length in the thermal-transfer mode. Thus, a desired density in the printing color can be obtained with respect to an overall area of a single paper. In short, it is possible to avoid the occurrence of the drop-out errors. As a result, a high printing quality can be obtained for the color printing.

[B] Second embodiment

Figure 6:
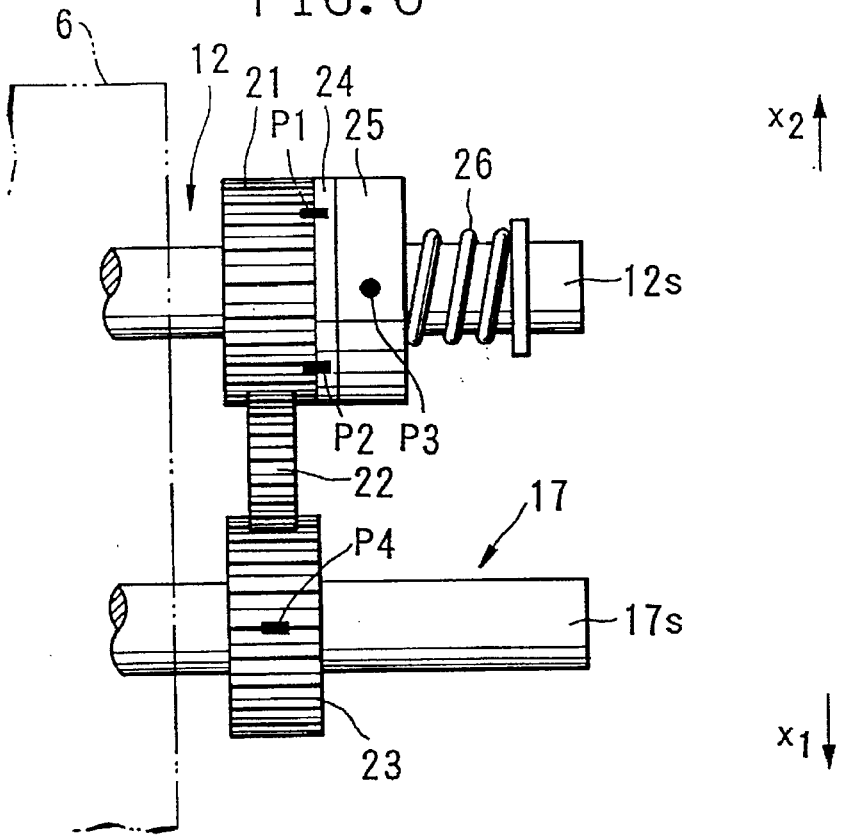
FIG. 6 is a plan view illustrating a mechanical structure of an essential part of a thermal-transfer-type color printer according to a second embodiment of the present invention.

FIG. 6 is a plan view illustrating a mechanical structure of an essential part of a thermal-transfer-type color printer according to a second embodiment of the present invention. In FIG. 6, the parts identical to those shown in FIG. 3 will be designated by the same numerals.

There are provided three gears 21 to 23, wherein the gear 21 engages with the gear 22, while the gear 22 engages with the gear 23. The gear 21 is equipped with a shaft of the platen roller 12 in the proximity of its shaft terminal 12*s* such that the gear 21 can freely rotate about the shaft. A disk plate 24 is fixedly attached to one-side face of the gear 21 by fixing members P1 and P2. As similar to the gear 21, this disk plate 24 is equipped with the shaft of the platen roller 12 such that the disk plate 24 can freely rotate about the shaft. Further, another disk plate 25 is provided to come in contact with one-side face of the disk plate 24. Unlike the disk plate 24, the disk plate 25 cannot rotate about the shaft of the platen roller 12. However, the disk plate 25 can be freely slid along the shaft of the platen roller 12. A connecting member P3 is provided to fix the position of the disk plate 25 with respect to the shaft of the platen roller 12. A spring 26 is also provided to impart a pressure to the disk plate 25 such that the disk plate 25 is pressed against the disk plate 24.

The gears 21 and 22 engage with each other. The gear 22 further engages with the gear 23 which is equipped with a shaft of the roller 17 in the proximity of its shaft terminal 17*s*. As described before, a number of the micro projections are formed on the overall peripheral surface of the roller 17. The gear 23 is fixedly attached to the shaft of the roller 17 by a fixing member P4. Numbers of gear teeth of the gears 21–23 are respectively determined in such a manner that a number of rotation "N1" of the gear 21 is made smaller than a number of rotation "N0" of the gear 23 (which is identical to a number of rotation of the roller 17).

In the printing mode, when the roller 17 is driven to rotate forward, the paper 6 is drawn in the direction x1. The force to draw the paper 6 acts like a torque to the platen roller 12. Under the effect of the torque, the platen roller 12 is forced to rotate at the number of rotation N0 of the roller 17. For convenience' sake, it is assumed that the same diameter is set for both of the shaft of the platen roller 12 and the shaft of the roller 17.

As described above, the gear 23 rotates at the number of rotation N0 of the roller 17, whereas the gear 21 rotates at the number of rotation N1 which is smaller than the number of rotation N0. In this case, the disk plate 25, which is fixedly attached to the shaft of the platen roller 12, is forced to rotate at the number of rotation N0 of the roller 17. On the other hand, the disk plate 24 rotates at the same number of rotation N1 (where N1<N0) of the gear 21. Due to the difference between the numbers of rotation, a friction force is produced and is imparted between the disk plates 24 and 25, so that the rotation of the disk plate 25 is depressively controlled.

Due to the depression in the rotation of the disk plate 25, the speed of rotation of the platen roller 12 is reduced. As a result, the platen roller 12 rotates at a certain number of rotation N2 (where N1<N2<N0) which is smaller than the number of rotation N0 of the roller 17.

The above-mentioned mechanism of the second embodiment controls the rotation of the platen roller 12 such that in the printing mode, the platen roller 12 normally rotates at a certain speed of rotation which is smaller than that of the roller 17. Thus, it is possible to avoid the deflection and inclination of the paper 6. Hence, it is possible to avoid the deviation in the printing positions among different colors of printed images. As a result, it is possible to improve the precision of overlapping the print dots among the plural colors of ink.

[C] Third embodiment

Figure 7:
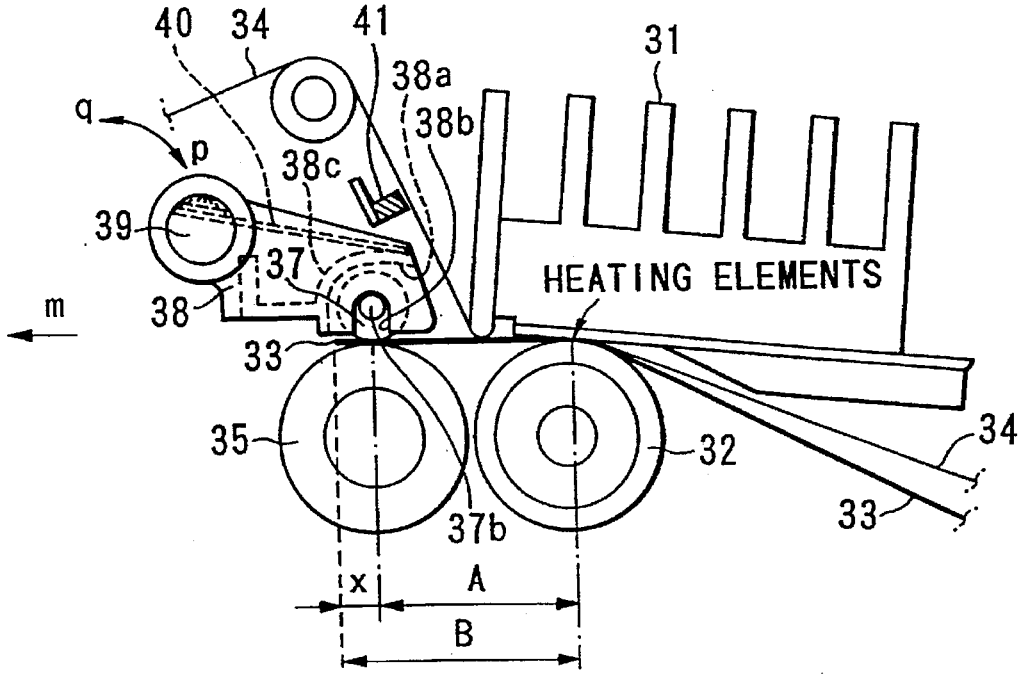
FIG. 7 is a drawing simply illustrating a mechanical structure of a thermal-transfer-type color printer to which a third embodiment of the present invention is applied.

FIG. 7 is a drawing simply illustrating a mechanical structure of a thermal-transfer-type color printer according to a third embodiment of the present invention.

In FIG. 7, a paper 33 and an ink ribbon 34 are pressed between a thermal head 31 and a platen roller 32. When the heating elements of the thermal head 31 are heated in accordance with the print data, a certain color of ink, painted on the ink ribbon 34, is melt and is transferred onto the paper 33.

In the conventional printer, a pinch roller (not shown) is provided to face with a micro-projection roller 35, so that the paper 33 is sandwiched between them. Thus, when the micro-projection roller 35 is rotated, the paper 33 is carried in a direction "m". Therefore, in a duration from a printing-start timing to a printing-end timing, the paper 33 is tightly sandwiched between the micro-projection roller 35 and the pinch roller and is not released from them. At the printing-end timing, a paper-releasing mechanism (not shown) is activated to release the pressure applied between the pinch roller and the micro-projection roller 35, so that the paper 33 is released from them. The ink ribbon 34 is wound up by a ribbon-winding roller (not shown) which is driven by a DC motor (not shown).

The position of the paper at the printing-start timing is as shown in FIG. 7. In the conventional printer providing the pinch roller, a certain length "X" (e.g., 2 mm) of the paper 33 is required to sandwich the paper 33 between the micro-projection roller 35 and the pinch roller, while another length "A" of the paper 33 is required between axes of the platen roller 32 and the micro-projection roller 35. Hence, a part of the paper 33 corresponding to a length "B", which is the sum of the lengths "X" and "A", cannot be subjected to printing. In other words, such part "B" of the paper 33 should be a margin area in which the printing cannot be performed.

Recently, however, there is a strong demand to enlarge the print area of the paper, having a regular size, in order to obtain a rich performance in the color printing. Hence, a margin length "B" should be reduced. In order to reduce the margin length "B", the length "A", which occupies a main part of the margin length "B", should be reduced. In order to do so, the pinch roller conventionally provided is moved close to the platen roller 32; however, a positional adjustment of the pinch roller is limited by the ink ribbon 34, which is moved around the thermal head 31, and an ink-ribbon-position sensor 41. So, another option to reduce the margin length is to reduce a roller diameter of the pinch roller. However, if the roller diameter of the pinch roller is reduced, the pinch roller itself should be deflected, which initiates the reduction of the pressure, between the pinch roller and the micro-projection roller 35, which should be sufficiently intense in order to certainly hold the paper. In other words, the conventional printer providing the pinch roller suffers from a problem that a precision of feeding the paper may be reduced.

Figure 8:
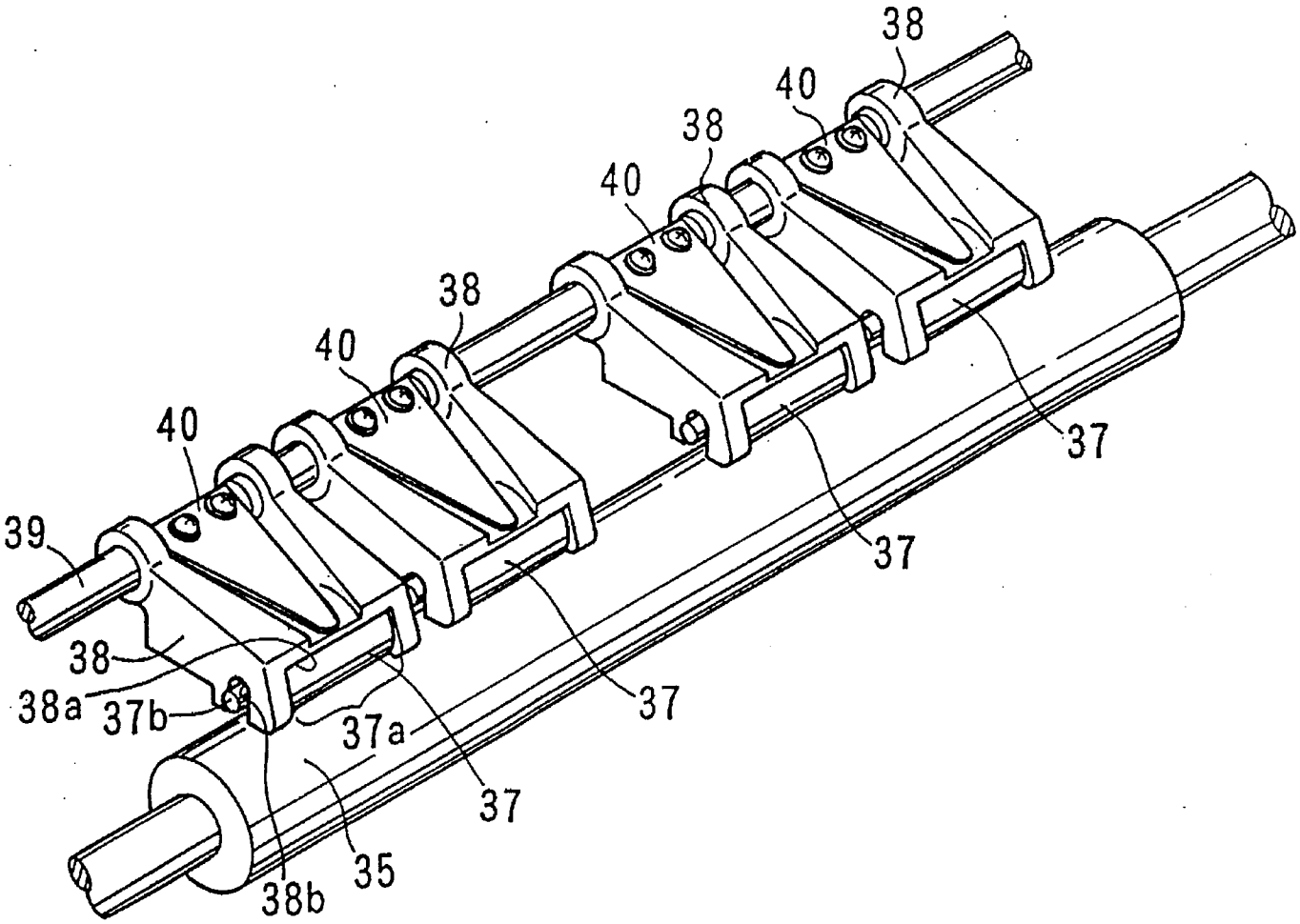
FIG. 8 is a perspective-side view illustrating an essential part in a paper-feed mechanism which is employed by the third embodiment.

The third embodiment is provided to enlarge the print area of the paper having the regular size as compared to the conventional printer. In order to do so, the pinch roller is replaced by a precise paper-feed mechanism consisting of members 37 to 40 which will be described below. FIG. 8 is a perspective-side view illustrating the paper-feed mechanism.

A numeral 38 represent a plurality of pinch-roller levers which loosely engage with a pinch-roller shaft 39. Each pinch-roller level provides a cut portion 38*a*, having a curved face, and another cut portion 38*b* having a letter-U-like face. A center portion of the pinch-roller lever 38 caves in as shown by a dotted line 38*c* (see FIG. 7).

A numeral 37 represents a plurality of free rollers. A roller diameter of the free roller 37 is very small as compared to the roller diameter of the pinch roller conventionally provided. A roller portion 37*a* of the free roller 37 is located inside the cut portion 38*a* of the pinch-roller lever 38, while each of projecting portions 37*b*, which are attached to both-side edges of the roller portion 38*a*, is tightly held by the cut portion 38*b*. Thus, the roller portion 37*a* of the free roller 37 is held at a position at which the roller portion 37*a* comes in contact with the micro-projection roller 35.

Since the roller diameter of the free roller 37 is made small, the micro-projection roller 35, which comes in contact with the free roller 37, can be located at a position, which is closer to the platen roller 32, without being interrupted by the ink ribbon 34 and the ink-ribbon-position sensor 41. Hence, as compared to the conventional printer, the length "A" of the paper 33, between the axes of the micro-projection roller 35 and the platen roller 32, can be reduced so much because of the paper-feed mechanism.

Next, a numeral 40 represents a plurality of pinch-roller-pressing springs, each of which has a roughly isosceles-triangle-like shape. A base portion of the pinch-roller-pressing spring 40 is attached to the pinch-roller shaft 39 by screws, while a vertex portion of the pinch-roller-pressing spring 40 comes in contact with a center of a tip-edge portion of the pinch-roller lever 38. In order to increase an attaching force of the pinch-roller-pressing spring 40, a chamfered portion is formed on a surface of the pinch-roller shaft 39 at a position to which the pinch-roller-pressing spring 40 is attached. In addition, a cam mechanism (not shown) is provided so that the pinch-roller shaft 39 can be rotably moved in a direction "p" or "q" (see FIG. 7).

In the printing mode, the pinch-roller shaft 39 is rotably moved in the direction "p" by a certain angle under the operation of the cam mechanism, so that each of the pinch-roller-pressing springs 40 presses each of the pinch-roller levers 38 against each of the free rollers 37. Thus, the projecting portions **37*b* of the free roller 37, which are held by the cut portions 38*b*, is pressed down, so that the free roller 37 is pressed in contact with the micro-projection roller 35. At the printing-start timing, the paper 33 is placed as shown in FIG. 7. Hence, the printing is performed on the paper 33 from a position which is located apart from a top-edge portion of the paper 33** by the length B which is the sum of the lengths X and A.

In accordance with a progress of the rotation of the micro-projection roller 35, the paper 33 is gradually moving in the direction "m". Herein, a certain color of ink, painted on the surface of the ink ribbon 34, is melt by heating the heating elements of the thermal head 31 and is transferred onto the paper 33.

When releasing the paper after the completion of the printing, the pinch-roller shaft 39 is rotably moved in the direction "q" so that the shaft 39 is returned to its original position which is set before performing the printing. Thus, the pressing force, which is applied to the free roller 37 by the pinch-roller-pressing spring 40, is released, so that the paper 33 is released.

According to the third embodiment described above, in the printing mode, the depressing pressure of the pinch-roller-pressing spring 40 is imparted to the free roller 37 by means of the pinch-roller lever 38 so that the free roller 37 is certainly pressed against the micro-projection roller 35. Thus, the third embodiment is advantageous in that the paper can be carried in a desired direction with accuracy without causing any deflection of the free roller 37 having a relatively small roller diameter. A reduction in the roller diameter of the free roller 37 can certainly contribute to the improvement of the paper-feed mechanism, by which the distance between the micro-projection roller 35 and the platen roller 32 can be reduced without being interrupted by the location of the ink ribbon 34 and the ink-ribbon-position sensor 41. In short, it is possible to remarkably reduce the top-margin area of the paper 33 in which the printing cannot be performed and which corresponds to the length B (see FIG. 7).

Incidentally, the third embodiment provides the cam mechanism by which the pinch-roller shaft 39 is rotably moved by a certain angle. Instead, it is possible to modify the third embodiment such that by rotating the pinch-roller shaft about its axis by a certain angle, an adjustment for pressing or not pressing the free rollers 37 against the micro-projection roller 35 can be achieved.

The third embodiment utilizes a plate spring having an isosceles-triangle-like shape as the pressing member by which the free rollers are pressed against the micro-projection roller 35. However, it is possible to use another member. For example, it is possible to use a plate spring having another shape, a coil spring and a rubber member as the pressing member.

[D] Fourth embodiment

Figure 9:
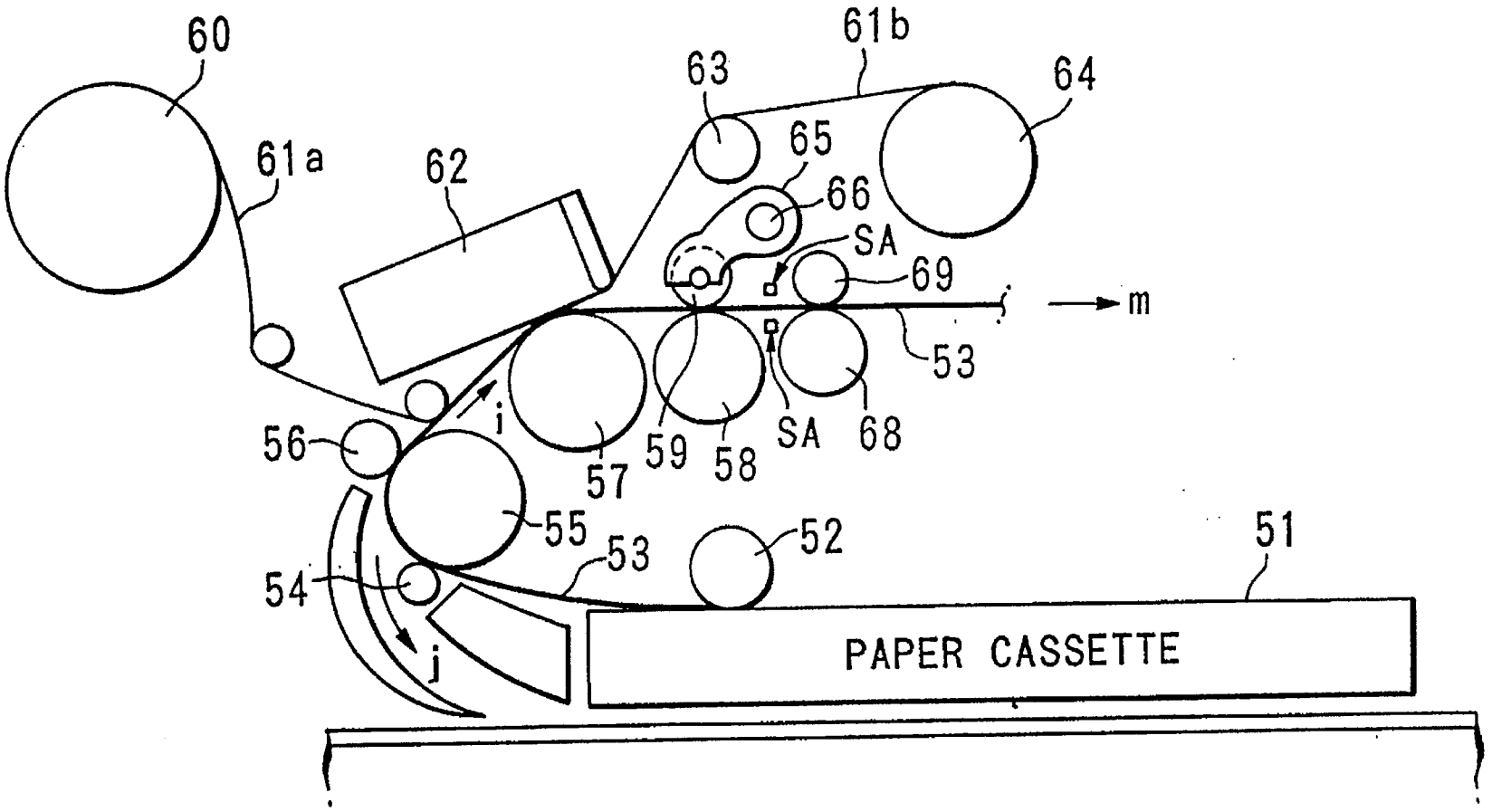
FIG. 9 is a drawing simply illustrating a mechanical structure of a thermal-transfer-type color printer to which a fourth embodiment of the present invention is applied.

FIG. 9 is a drawing simply illustrating a mechanical structure of a thermal-transfer-type color printer according to a fourth embodiment of the present invention. The fourth embodiment is provided to improve the precision of carrying the paper in the printer using plural kinds of paper materials.

In FIG. 9, a numeral 51 denotes a paper cassette which stores papers onto which print images are to be transferred. As paper materials, it is possible to use sheets for an over-head projector (i.e., OHP) other than the plain papers.

Next, a numeral 52 denotes a paper-supply roller by which each of papers 53 is taken out from the paper cassette 51. This printer uses several kinds of drive rollers and auxiliary rollers in order to feed the paper 53 in a predetermined course. That is, there are provided a feed roller 55, pinch rollers 54 and 56, a platen roller 57, a feed roller 58, pinch rollers 59, an ejection roller 68 and a pinch roller 69.

A numeral 60 denotes an ink-ribbon-supply roller around which an un-used ink ribbon **61*a* is wound, while a numeral 64 denotes an ink-ribbon-winding roller by which a used ink ribbon 61*b* is wound up. A guide roller 63** is provided at a certain position in a path, through which the ink ribbon passes.

Three or four colors of ink are sequentially and repeatedly painted on the surface of the ink ribbon **61*a*** in its longitudinal direction.

Figure 10B:
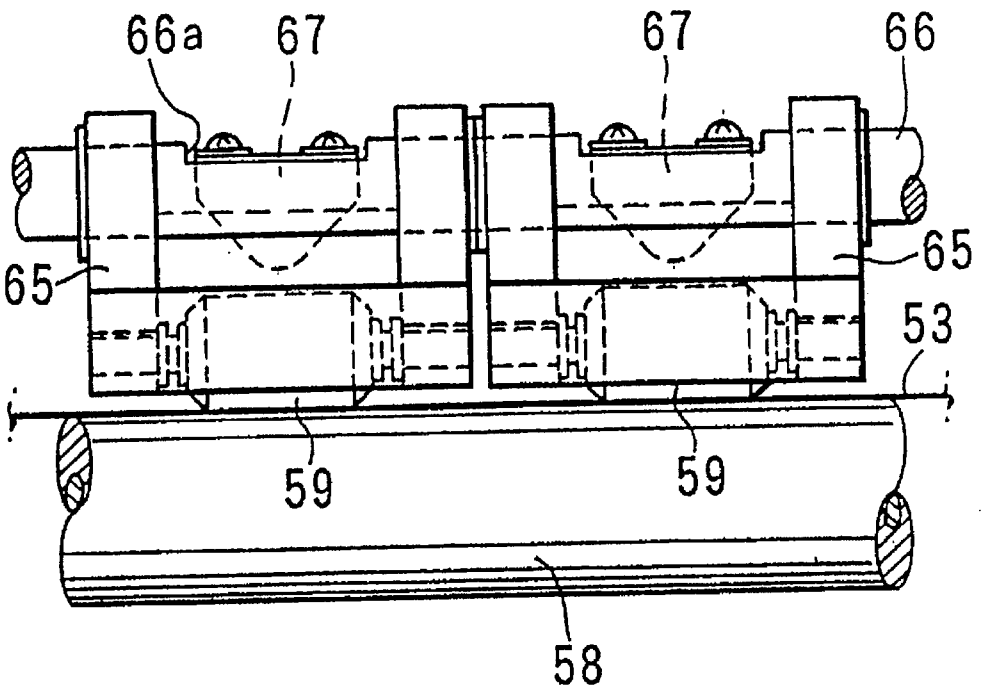
FIG. 10B is a back-side view illustrating the pinch-roller pressing mechanism.
Figure 10A:
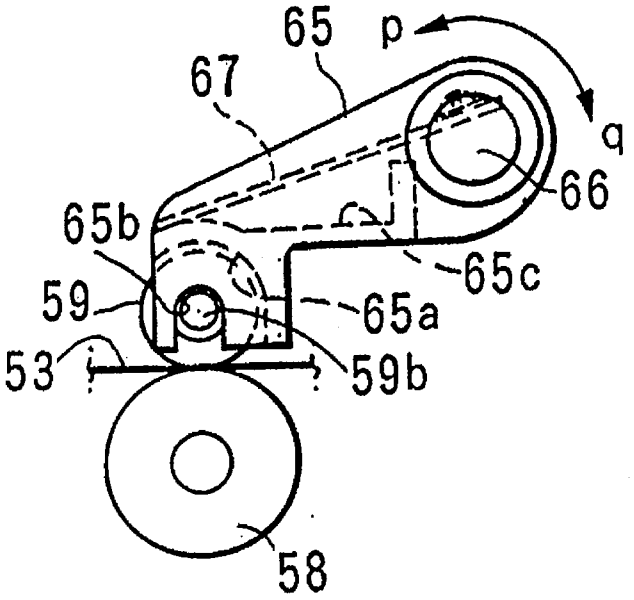
FIG. 10A is a side view illustrating a mechanical structure of a pinch-roller pressing mechanism.
Figure 11:
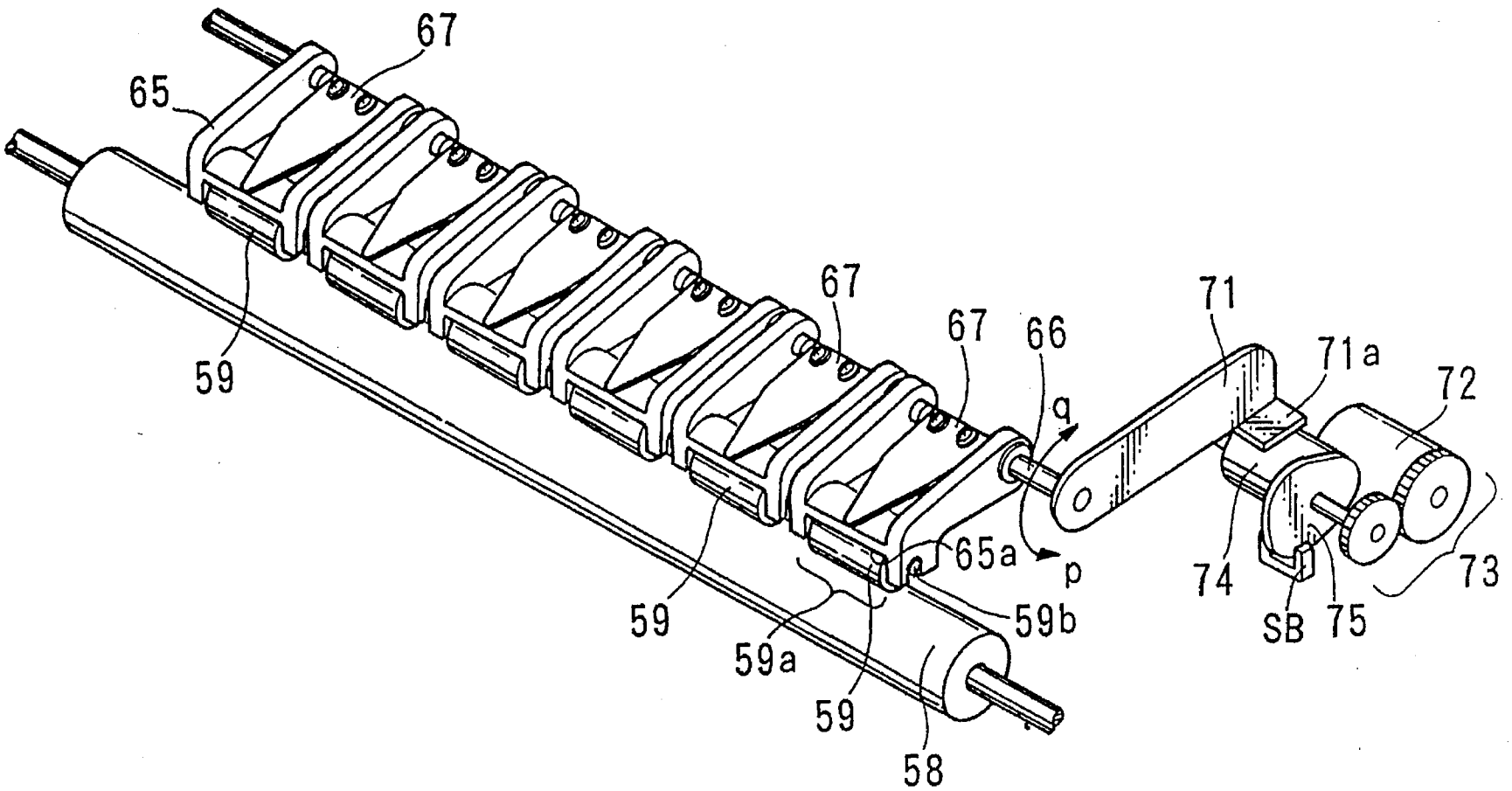
FIG. 11 is a perspective-side view illustrating a cam mechanism which activates the pinch-roller pressing mechanism.

A numeral 65 denotes a pinch-roller lever. In the printing mode in which a thermal head 62 is heated, this pinch-roller lever 65 is pressed by a pressing means so that the pinch-roller lever 65 eventually presses the pinch roller 59 against the feed roller 58. The mechanical structure of the pinch-roller lever 65 and the pressing means is shown by FIGS. 10A and 10B, wherein FIG. 10A is a side view and FIG. 10B is a back-side view. A cam mechanism which activates the pressing means is shown in FIG. 11.

In those drawings, a plurality of pinch-roller levers 65 are loosely attached to a support shaft 66. The pinch-roller lever 65 provides a cut portion **65*a*, having a curved face, and another cut portion 65*b* having a letter-U-like shape. A center portion of the pinch-roller lever 65 caves in as shown by a dotted line 65*c* (see FIG. 10**A).

There are provided a plurality of pinch rollers 59 along the feed roller 58. Each pinch roller 59 provides a roller portion **59*a* which is located inside the cut portion 65*a*. In addition, projecting portions 59*b*, which are attached to both-edge portions of the roller portion 59*a* of the pinch roller 59, are held by the cut portions 65*b* of the pinch-roller lever 65. Thus, the locations of the pinch rollers 59 are maintained such that the pinch rollers 59 normally come in contact with the feed roller 58**.

A numeral 67 represents springs each having a roughly isosceles-triangle-like shape. As shown in FIGS. 10B and 11, a base portion of the spring 67 is attached to a chamfered portion **66*a* of the support shaft 66 by screws, while a vertex portion comes in contact with a center of a tip-edge portion of the pinch-roller lever 65**.

In FIG. 11, a numeral 71 denotes a cam lever which is connected with the support shaft 66. An overhang portion 71*a* is located above a cam 74. The cam 74 is subjected to eccentric rotation because of operations of a drive motor 72 and gears 73. In synchronism with an up/down movement of the cam 74, the cam lever 71 rotably moves the support shaft 66 in the direction "p" or "q".

Figure 12A:
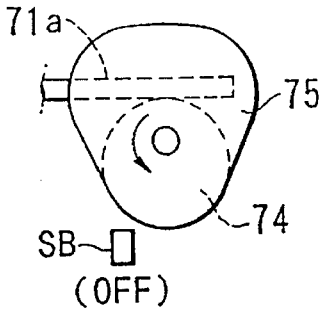
FIGS. 12A and 12B are side views, each illustrating a positional relationship between a cam plate and a sensor.
Figure 12B:
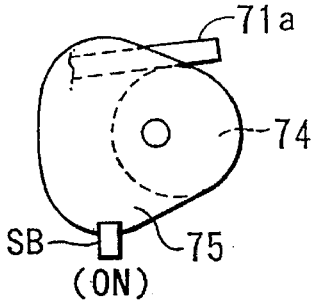

Further, a numeral 75 denotes a cam plate which rotates in synchronism with the cam 74. A sensor SB, having a rectangular-like shape, in which one of four side portions is cut so that a part of the cam plate 75 can pass through, is provided to send a signal to a control means (not shown). The signal is turned on when a part of the cam plate 75 passes through the sensor SB, while the signal is turned off when a part of the cam plate 75 does not pass through the sensor SB. FIGS. 12A and 12B are drawings, each of which shows a positional relationship between the cam plate 75 and the sensor SB. Those drawings are obtained by observing the cam plate 75 and the sensor SB from a position of the gears 73.

Now, the paper 53, which is taken out from the paper cassette 51 by the paper-supply roller 52, is carried in a direction "i" (see FIG. 9) by the feed roller 55 and is led to a place between the feed roller 58 and the pinch rollers 59 by means of the platen roller 57.

When a part of the paper 53 reaches the place between the rollers 58 and 59, the state of rotation of the cam plate 75 is as shown in FIG. 12A. At this time, the sensor SB does not detect the cam plate 75. In this case, the cam 74 is located at the lowest position in a vertical direction; therefore, the overhand portion 71*a* of the cam lever 71 is also located at the lowest position. Thus, the support shaft 66 is placed at a position by which the spring 67 does not press the pinch-roller lever 65 against the pinch roller 59. In this state, no pressure is imparted between the feed roller 58 and the pinch rollers 59.

Next, when receiving a printing-start signal, the control means drives the drive motor 72 so that the cam 74, which is in the state as shown in FIG. 12A at first, begins to perform an eccentric rotation in an arrow direction. Due to the eccentric rotation of the cam 74, the overhang portion 71*a* gradually moves upward. The movement of the overhand portion 71*a* is transmitted to the support shaft 66 by means of the cam lever 71, so that the support shaft 66 gradually rotates in the direction "p" (see FIG. 10A or 11). Thus, the spring 67 gradually presses the pinch-roller lever 65 against the pinch roller 59.

Then, the sensor SB detects the cam plate 75 as shown in FIG. 12B, so that the signal supplied to the control means, is turned on. Upon the receipt of this signal, the control means stops the drive motor 72, so that the movement of the cam 74 is stopped in the state as shown by FIG. 12B.

In this state, the projecting portions 59*b*, held by the cut portions 65*b* of the pinch-roller lever 65, are pressed down, so that the pinch roller 59 is pressed against the feed roller 58. Thus, the paper 53 is held between the feed roller 58 and the pinch rollers 59 by a certain pressure. Then, the feed roller 58 rotates by a certain angle, so that the paper 53 is carried to a printing-start position which is determined in advance. In addition, the thermal head 62 is pressed against the platen roller 57 by the spring (not shown).

Thereafter, accompanied with the rotation of the feed roller 58 and the ejection roller 68, the paper 53 is carried in a direction "m" (see FIG. 9). The heating elements of the thermal head 62 are heated in accordance with the print data, so that first-color ink is melt and transferred onto the paper 53.

Next, in order to overlapping second-color ink with the first-color ink which has been transferred onto the paper 53, the thermal head 62 is returned back to the original position; and the feed rollers 58 and 55 rotate backward so that the paper 53 is carried back in a direction "j", so that the paper 53 is returned back to the original printing-start position. Then, as similar to the thermal-transfer operation of the first-color ink, the second-color ink is transferred onto the paper 53. Similarly, the thermal-transfer operation is repeatedly performed with respect to third-color ink and fourth-color ink. Thus, the color printing is performed on a single paper 53, onto which characters and/or images are transferred in desired colors.

As described before, in order to obtain a high printing quality in the multi-color printing, it is necessary to improve the precision of overlapping the print dots among the plural colors of ink. In order to do so, the precision of feeding the paper 53 should be improved. For this reason, micro projections (not shown), each having a diameter of tens of micro-meters, are formed on the overall peripheral surface of the feed roller 58. Thus, the coefficient of friction becomes large, in other words, the mutual pressure applied between the feed roller 58 and the pinch rollers 59 is increased.

In the paper-feed mechanism described above, however, the pressing force, which is imparted to the pinch roller 59 by the pinch-roller lever 65 in the printing mode, is maintained constant because of the operation of the cam mechanism which operates responsive to the detection signal of the sensor SB.

In the actual printing, the OHP sheet is sometimes used as the paper material other than the plain paper. The OHP sheet is different from the plain paper in the rigidity and the coefficient of friction. Therefore, as compared to the plain paper, a relatively large force is required to feed the OHP sheet. When using the OHP sheet, the pressure, which is imparted to the pinch roller 59 by the pinch-roller lever 65, should be increased.

However, if the position of the sensor SB and the shape of the cam plate 75 are changed to obtain an appropriate pressing force against the OHP sheet, an excessive pressure may be imparted to the paper. If the excessive pressure is imparted to the paper, the micro projections formed around the surface of the feed roller 58 initiate the formation of the recesses on the paper.

Thus, the paper-feed mechanism should be improved. In order to do so, a number of sensors is increased. In FIG. 9, a sensor SA, consisting of two sensor portions, are provided, wherein first sensor portion is located above the paper 53, between the pinch roller 66 and the pinch roller 59, to face with second sensor portion through the paper 53, and the second sensor portion is located beneath the paper 53 between the feed roller 58 and the ejection roller 68. The first sensor portion is configured as a light-emitting portion, while the second sensor portion is configured as a light-receiving portion. Hence, the light, emitted from the light-emitting portion, is transmitted through the paper 53 and is received by the light-receiving portion. The amount of light received by the light-receiving portion depends upon the type of the paper material to be used. As compared to the plain paper, the light-receiving portion receives much amount of light when using the OHP sheet.

Figure 13A:
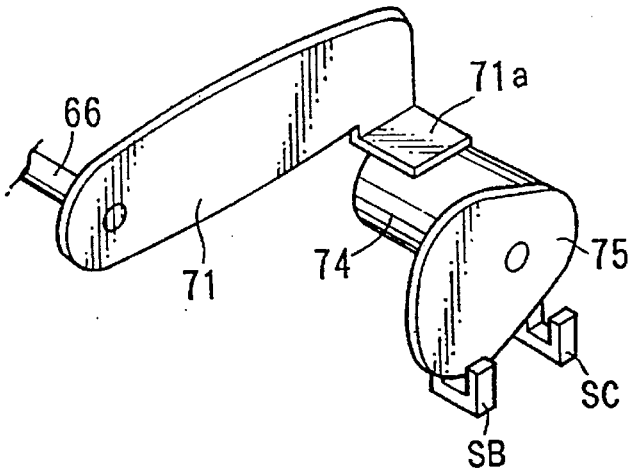
FIG. 13A is a perspective-side view illustrating an improved cam mechanism employed by the fourth embodiment.

FIG. 13A shows a part of the cam mechanism used by the present embodiment. As compared to the cam mechanism shown in FIG. 11, this cam mechanism shown in FIG. 13A is improved by providing two sensors SB and SC. Both of the sensors SB and SC have the same shape, which is described before. Like FIGS. 12A and 12B, FIGS. 13A to 13C are drawings, each of which illustrates a positional relationship among the cam plate 75 and the sensors SB and SC.

Figure 13B:
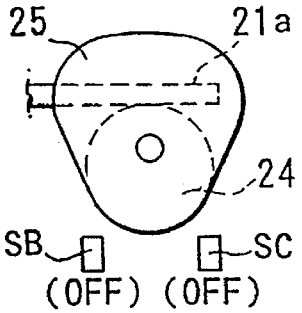
FIGS. 13B, 13C and 13D are side views, each illustrating a positional relationship among a cam plate and sensors.
Figure 13C:
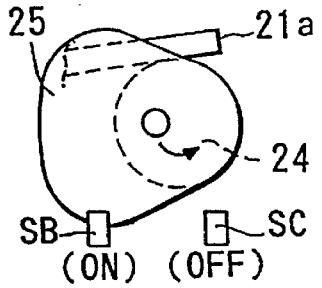

Now, when the paper, newly introduced, is led to a place between the feed roller 58 and the pinch rollers 59 so that the control means sends out the printing-start signal, the cam 74, which is originally set in a state as shown in FIG. 13B, is rotated to be in a state as shown in FIG. 13C. In the state shown in FIG. 13C, the cam plate 75 is detected by the sensor SB; however, the sensor SC is in an off-state. Then, the pressing force is applied to the paper 53, so that the paper 53 is carried to the printing-start position.

Next, the light, emitted from the light-emitting portion of the sensor SA, transmits through the paper 53 and is received by the light-receiving portion. Thus, the sensor SA outputs a detection signal, which corresponds to the amount of light received, to the control means. A certain threshold level is set in the control means in advance. Hence, the level of the detection signal is compared to the threshold level. When the amount of light received is smaller than the threshold level, in other words, when the plain paper is used as the paper material, the control means immediately instructs the printer to start the printing by activating the thermal head 62. While performing the printing, the paper 53 (i.e., the plain paper) is tightly held between the feed roller 58 and the pinch rollers 59 and is carried in the direction "m". In this case, the holding pressure, which is imparted to the paper 53 between the feed roller 58 and the pinch rollers 59, is appropriately set with respect to the type of the paper material. Therefore, no recesses or no scratches are apparently formed on the paper 53 by the micro projections of the feed roller 58.

In contrast, when the amount of light received is larger than the threshold level, in other words, when the OHP sheet is used as the paper material, the control means drives the drive motor 72 to rotate the cam 74, which is currently in the state shown in FIG. 13C, in an arrow direction. Thus, the overhang portion 71*a* is further elevated up, so that the support shaft 66 further and gradually rotates in the direction "p" (see FIG. 11) by means of the cam level 71. Accompanied with this movement of the support shaft 66, the spring 67 further depresses the pinch-roller lever 65 against the pinch roller 59.

Figure 13D:
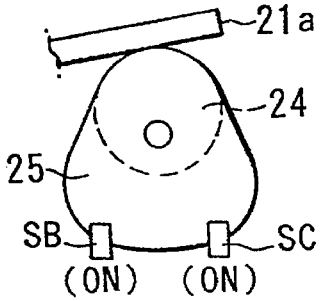

Then, the cam 74 reaches a state as shown in FIG. 13D, wherein the sensor SC detects the cam plate 75 so that the detection signal, supplied to the control means, is turned on. Hence, the control means stops the rotation of the drive motor 72.

In the state shown in FIG. 18D, the cam 74 reaches the highest position in the vertical direction, in other words, the support shaft 66 is in a state where the pressing force of the spring 67, by which the pinch roller 65 depresses the pinch roller 59, becomes the largest. In that case, the projecting portions 59*b*, which are held by the cut portions 65*b*, is depressed by the pressing force which is larger than the pressing force which is set when using the plain paper. Hence, each of the pinch rollers 59 is pressed against the feed roller 58 more intensively. Then, the printing using the thermal head 62 is started, so that the paper 53 (i.e., the OHP sheet) is started to be carried in the direction "m" while being held between the feed roller 58 and the pinch rollers 59. During the printing, an appropriate pressing force is applied to the OHP sheet between those rollers. Thus, even the OHP sheet, whose rigidity and coefficient of friction are large as compared to the plain paper, can be carried in a desired direction with accuracy.

As described heretofore, the fourth embodiment is characterized by that the sensor SA is used to discriminate the type of the paper material (which is either the plain paper or the OHP sheet) and that the paper material is carried with accuracy by the holding pressure which is appropriately set for each of the paper materials. Hence, it is possible to obtain a sufficient precision in the feeding operation of the paper material; and it is also possible to perform the color printing with a high printing quality. And, no recesses or no scratches are apparently formed on the paper material because the appropriate holding pressure is selected for each of the paper materials.

The fourth embodiment uses two sensors SB and SC by which the pressing force applied to the pinch roller 59 is changed in two stages. However, it is possible to modify the fourth embodiment to increase the number of stages by which the pressing force is changed. In order to do so, the number of the sensors (SA), which are used to discriminate the type of the paper material, can be increased; or the shape of the cam plate 75 can be changed.

[E] Fifth embodiment

Figure 14:
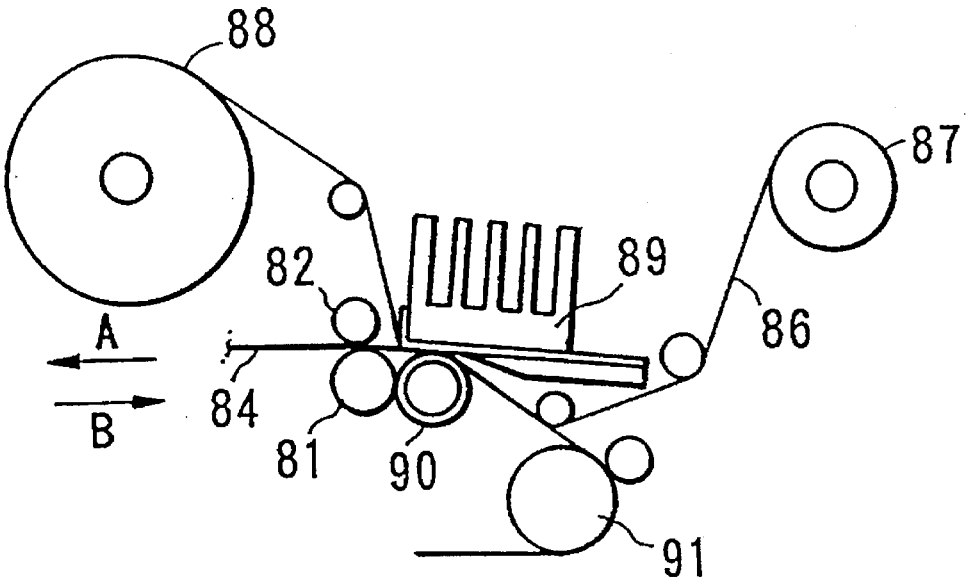
FIG. 14 is a drawing simply illustrating a mechanical structure of a thermal-transfer-type color printer to which a fifth embodiment of the present invention is applied.
Figure 15:
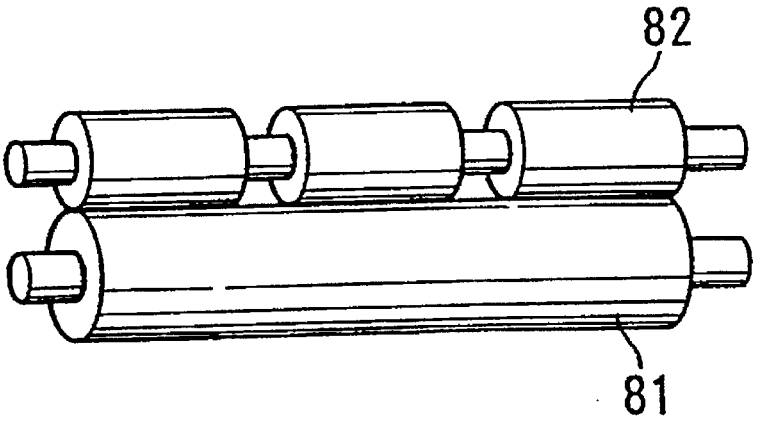
FIG. 15 is a perspective-side view illustrating a relationship between a paper-feed roller and a rubber roller.

FIG. 14 shows a thermal-transfer-type color printer to which a fifth embodiment of the present invention is applied. In FIG. 14, there are provided a paper-feed roller 81, a rubber roller 82, a ribbon-supply roller 87, a ribbon-winding roller 88, a thermal head 89, a platen roller 90 and a paper guide 91. In the printing mode, an ink ribbon 86 and a paper 84 are sandwiched between the thermal head 89 and the platen roller 90. The paper guide 91 is provided to introduce the paper 84 between the thermal head 89 and the platen roller 90. FIG. 15 is a perspective-side view illustrating a relationship between the paper-feed roller 81 and the rubber roller 82.

Figure 16:
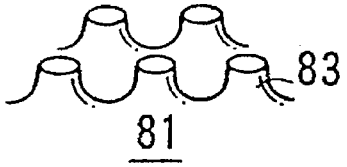
FIG. 16 is a perspective-side view illustrating micro projections formed on a surface of the paper-feed roller.

The paper-feed roller 81 and the rubber roller 82 rotate forward or backward in a direction "A" or "B" in the state where the paper 84, which passes through the thermal-transfer portion of the printer, is tightly sandwiched between the rollers 81 and 82. The paper-feed roller is manufactured from the base material made of the stainless steel, carbon steel or other metal materials. As shown in FIG. 16, a number of micro projections 83 are uniformly formed on the peripheral surface of the paper-feed roller 81 by effecting the etching process or the like. If a certain base material, which is made by the carbon steel other than the stainless steel, is used to manufacture the paper-feed roller 81, the plating process may be effected after the micro projections 83 are formed by the etching process. This plating process is required to improve the rust prevention and abrasion resistance. As the method of forming the micro projections, it is possible to employ a method in which the surface of the roller is directly subjected to etching process. Instead of this method, it is possible to employ another method in which after forming the micro projections on a thin flat-plate, the thin flat-plate is attached to the surface of the roller in a spiral manner.

Figure 17:
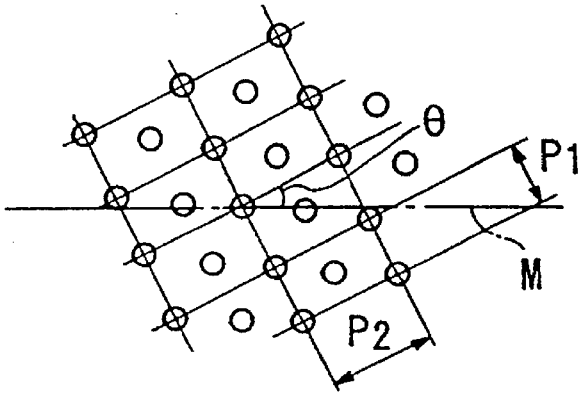
FIG. 17 is a plain view illustrating an arrangement of the micro projections.

Arrangement and density of the micro projections and a diameter of each micro projection depend upon the type of the paper material to be used. Because, the printer uses a variety of paper materials, such as the plain paper, synthetic paper, coated paper, plastic film and plastic sheet. In contrast, a uniform shape can be employed for the micro projection, regardless of the type of the paper material to be used. Due to nonuniformity in the etching process, a small dispersion may be occurred in the sizes of the micro projections. FIG. 17 is a plain view illustrating an arrangement of the micro projections. In FIG. 17, a dashed line M indicates an axis line of the paper-feed roller 81. In order to provide a better understanding in the direction of arrangement of the micro projections, center points of the micro projections are connected by straight lines. In a direction which departs from the axis line of the paper-feed roller 81 by an angle θ, the micro projections are regularly arranged at the same intervals of pitch $P_2$. In another direction which is perpendicular to the above-mentioned direction, the micro projections are regularly arranged at the same intervals of pitch $P_1$.

Figure 18:
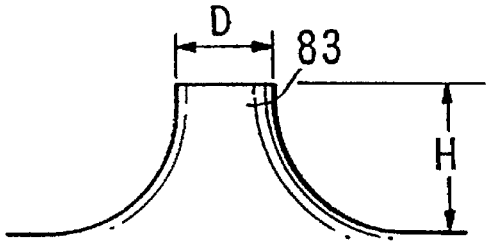
FIG. 18 is a sectional view illustrating a shape of the micro projection vertically cut.
Figure 19:
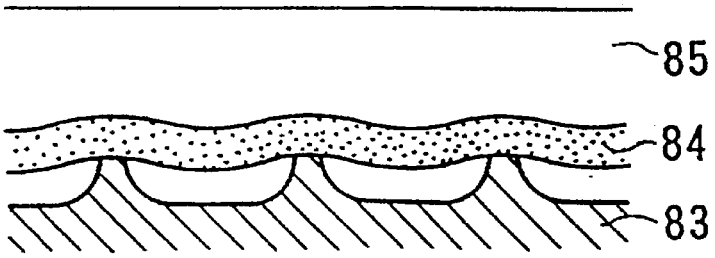
FIG. 19 is a state of a paper which is sandwiched between the paper-feed roller and rubber roller.

FIG. 18 is a sectional view which is obtained by cutting the micro projection 83 by a plane containing the axis line of the paper-feed roller 81. As shown in FIGS. 16 to 18, the micro projection 83 has a cone-like shape, in which a top portion of the cone is cut out. A horizontal diameter of the micro projection 83 gradually becomes smaller as the height becomes higher. In the color printer, a top portion of the micro projection 83 has a certain diameter "D" which ranges from tens of micro-meters to hundreds of micro-meters, while a height "H" ranges from tens of micro-meters to hundreds of micro-meters.

Figure 20A:
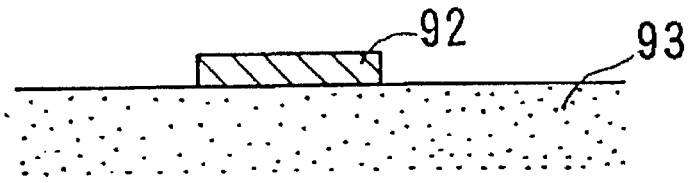
FIGS. 20A, 20B, 20C and 20D are sectional views which are used to explain a manufacturing process of the micro projections.
Figure 20B:
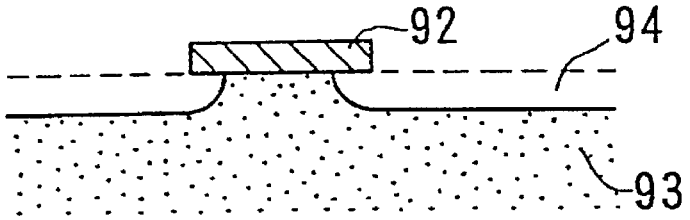
Figure 20C:
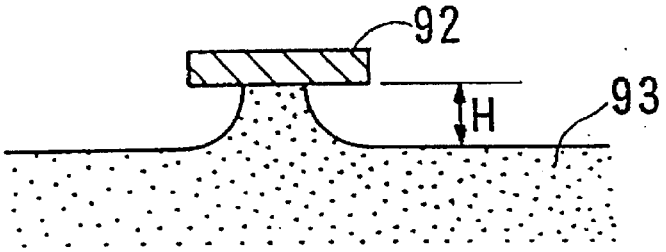
Figure 20D:
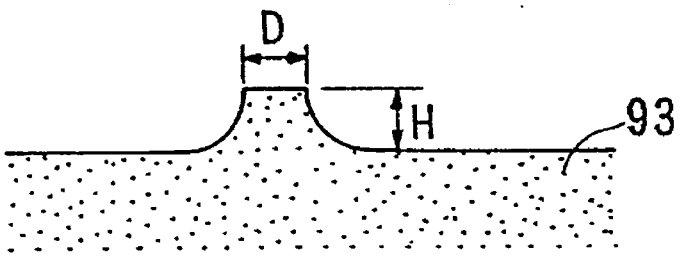

Next, processes for manufacturing the micro projections 83 on the peripheral surface of the paper-feed roller 81 will be described with reference to FIGS. 20A to 20D. At first, a resist is attached to a metal material 93 which is used as the material for manufacturing the roller 81. Then, exposure and development are effected so that a mask pattern 92 is formed on the metal material 93 as shown in FIG. 20A. Next, the roller 81 as a whole is put in an etching solution so as to effect an etching process on the metal material 93. Due to the etching process, areas of the metal material 93, which are not covered by the mask pattern 92, are gradually etched as shown in FIG. 20B. This etching process is continuously effected until a depth, which is measured between an etched surface of the metal material 93 and a bottom level of the mask pattern 92, becomes equal to "H" as shown in FIG. 20C. After the completion of the etching process, the resist is removed. As a result, it is possible to form a micro projection on the metal material 93 as shown in FIG. 20D. Thus, the roller 81, on which surface a plenty of micro projections are formed, can be obtained.

In general, however, it is difficult to effect the etching process uniformly on the overall surface of the roller 81 in the process of forming the micro projections. Therefore, the etching process may be sometimes advanced fast in a certain area of the roller 81, while the etching process may be sometimes advanced slowly in another area of the roller 81. In an extreme case, the etching process advances too fast on a certain area of the roller 81, so that the micro projection cannot be formed. Thus, as the size of the roller becomes larger, the yield in the formation of the micro projections in the desired manner becomes lower. Moreover, each type of the paper material should have an appropriate diameter "D". However, the paper-feed roller 81 can have only one kind of micro projection in terms of the diameter; therefore, it is difficult to properly deal with different kinds of paper materials.

Thus, it is required that the following demands are satisfied in the thermal-transfer-type color printer.

① Even if the dispersion is occurred in the etching process effected on the metal material of the paper-feed roller, the yield of the formation of the micro projections in the desired manner can be maintained as highly as possible.

② The paper-feed roller should be improved in such a manner that the plural kinds of paper materials can be used.

Figure 21:
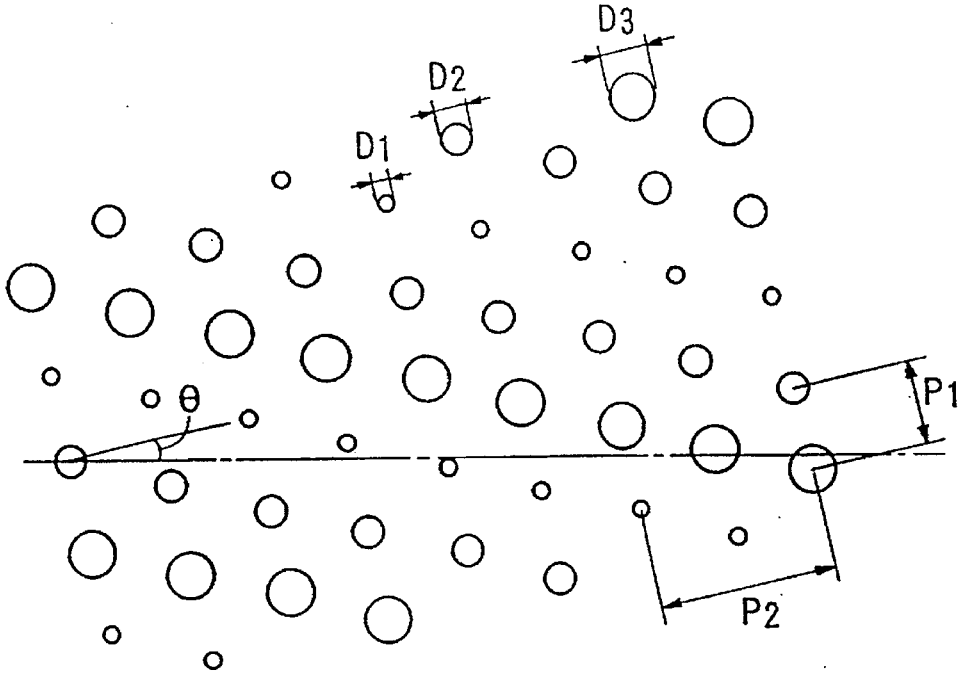
FIG. 21 is a plan view illustrating an arrangement of different kinds of resist patterns on the surface of the paper-feed roller which is employed by the fifth embodiment of the present invention.

In order to satisfy the above-mentioned demands, an improvement is made in the formation of the micro projections on the surface of the paper-feed roller in such a manner that plural kinds of micro projections are formed by providing plural kinds of resist patterns. FIG. 21 shows an example of an arrangement of different kinds of micro projections. In FIG. 21, there are provided three kinds of micro projections which have diameters of D1, D2 and D3 respectively. Herein, there is established a relationship among those diameters as expressed by a following inequality: D1<D2<D3. The present embodiment sets a target diameter "D" for the top portion of the micro projection. Thus, the diameter of the resist pattern, which is used to form the micro projection in the target diameter D, is set equal to D2, for example.

Then, the etching process is effected on the metal material of the paper-feed roller, on which surface three kinds of resist patterns having the diameters D1, D2 and D3 respectively, are formed. Due to the dispersion in the etching process described before, in the area in which the etching process advances fast, the micro projection is not formed beneath the resist pattern having the smallest diameter D1. In that area, the diameter of the micro projection to be formed beneath the resist pattern having the diameter D2 is smaller than the target diameter D. However, the diameter of the micro projection to be formed beneath the resist pattern having the largest diameter D3 is roughly equal to the target diameter D.

In contrast, in the area in which the etching process advances slowly, the diameter of the micro projection to be formed beneath the resist pattern having the diameter D2 is larger than the target diameter D, while the diameter of the micro projection to be formed beneath the resist pattern having the diameter D1 is roughly equal to the target diameter D. Those micro projections should be formed at least in a certain surface area of the roller 81 which actually comes in contact with the rubber roller 82. In other words, it is not necessary to form the micro projections in the overall surface area of the roller 81.

Figure 22:
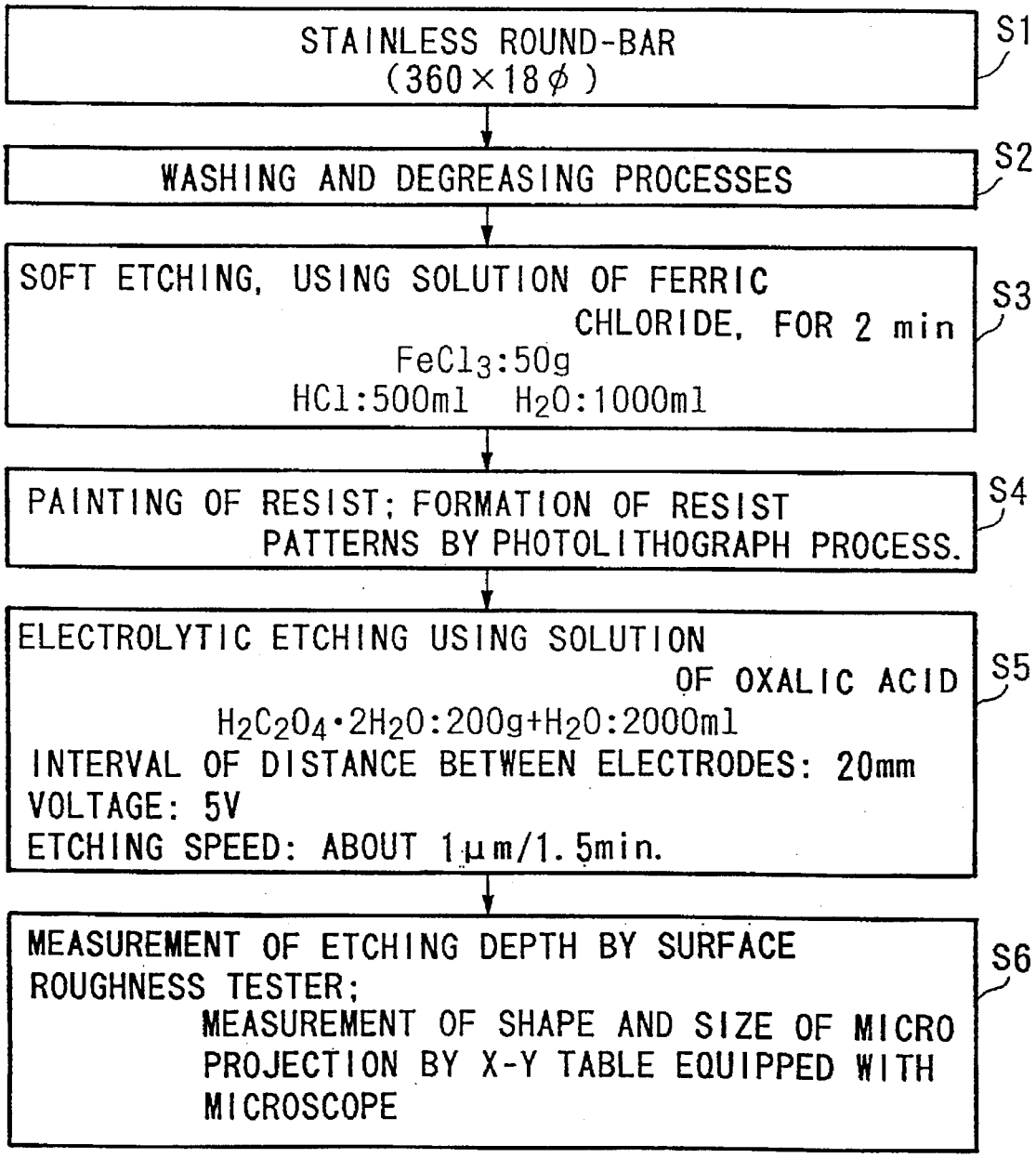
FIG. 22 is a flowchart showing a process for manufacturing a sample of the paper-feed roller on which surface the micro projections are formed.

In order to examine the effects of the manufacturing process of the paper-feed roller, we have actually manufactured samples of the paper-feed roller. In one sample of the paper-feed roller, a stainless round-bar is uses as the base material for the paper-feed roller; and the diameters D1 to D3 are set as follows: D1=135 μm, D2=145 μm and D3=157 μm. FIG. 22 shows a flowchart for the manufacturing process of the sample of the paper-feed roller. In first step S1, the stainless round-bar is provided. In next step S2, degreasing and washing processes are effected on the surface of the stainless round-bar. Then, a soft etching, using the solution of ferric chloride (which contains $FeCl_3$ of 50 g, HCl of 500 ml and $H_2O$ of 1000 ml). is effected on the stainless round-bar for two minutes in step S3. Thereafter, the resist material is painted on the surface of the stainless round-bar; and then, the photolithgraphy process is effected to form the resist patterns as shown in FIG. 21 in step S4. Next, the stainless round-bar on which surface the resist patterns are formed is soaked into the bath containing the solution of oxalic acid (which contains $H_2C_2O_4 \cdot 2H_2O$ of 200 g and $H_2O$ of 2000 ml); and then, an electrolytic etching is effected under a specific condition where an interval of distance between electrodes is set at 200 mm, voltage is set at 5 V and an etching speed is set at about 1 μm/1.5 min. in step S5. After the completion of the electrolytic etching, a surface roughness tester is used to measure the etching depth; and an X-Y table equipped with a microscope is used to measure the shape and size of the micro projection in step S6. In the step S6, the manufactured sample of the roller is observed in detail with respect to the sizes of the micro projections. In other words, the detailed observation is carried out on each of three areas, wherein the etching process advances at a normal speed in a first area; the etching process advances slowly in a second area; and the etching process advances fast in a third area. In each of those areas, the size of the micro projection is measured. The result of the measurement is shown in Table 1 (see next page).

Table 1 proves that the micro projection having the target diameter of 30 μm can be obtained in each of the areas.

Figure 23:
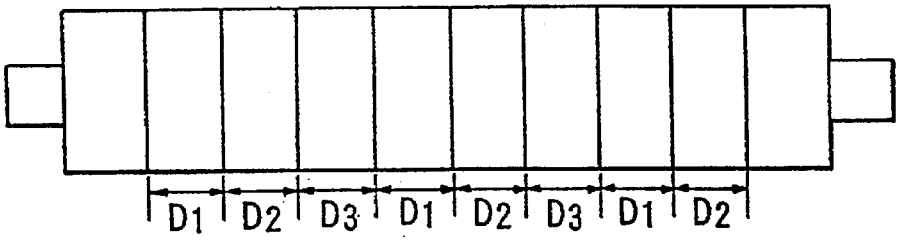
FIG. 23 is a side view illustrating an example of a paper-feed roller whose overall surface is divided into a plurality of zones.
Figure 24:
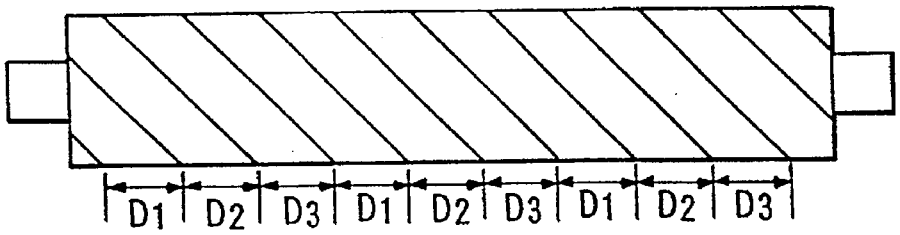
FIG. 24 is a side view illustrating another example of a paper-feed roller whose overall surface is divided into a plurality of zones.

In the surface of the paper-feed roller shown in FIG. 21, the plural kinds of micro projections each having a different diameter are uniformly arranged in the overall surface of the paper-feed roller. However, the manufacturing manner of the micro projections in accordance with the fifth embodiment of the present invention can be modified such that the overall surface of the roller is divided into a plurality of zones as shown in FIG. 23 or 24; and the diameter of the micro projections formed in one zone is differed from that of the micro projections formed in another zone.

TABLE 1

| | diameter of resist pattern | finished diameter | etching depth |
|---|---|---|---|
| First area | D1 = 135 μm | 19 μm | 50 μm |
| (normal | D2 = 145 μm | 31 μm | 50 μm |
| etching) | D3 = 157 μm | 42 μm | 50 μm |
| Second area | D1 = 135 μm | 30 μm | 45 μm |
| (slow | D2 = 145 μm | 42 μm | 45 μm |
| etching) | D3 = 157 μm | 55 μm | 45 μm |
| Third area | D1 = 135 μm | 8 μm | 55 μm |
| (fast | D2 = 145 μm | 15 μm | 55 μm |
| etching) | D3 = 157 μm | 31 μm | 55 μm |

Further, the shape of the micro projection is not limited to the shape as shown in FIG. 16. Hence, it is possible to employ another shape which can be arbitrarily selected from the triangular shape, rectangular shape, polygon shape, star-like shape, elliptic shape and the like.

[F] Sixth embodiment

Figure 25:
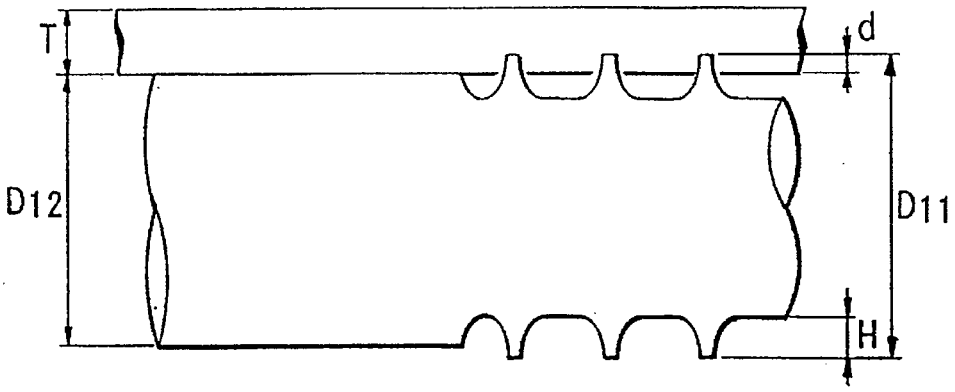
FIG. 25 is a side view simply illustrating a paper-feed roller which is employed by a sixth embodiment of the present invention.

Next, a sixth embodiment of the present invention will be described. The sixth embodiment is characterized by a brand-new shape of the paper-feed roller. FIG. 25 shows an example of the paper-feed roller which is designed in accordance with the sixth embodiment of the present invention. This paper-feed roller is characterized by providing two areas, wherein the micro projections are formed in first area, while the micro projections are not formed in second area. Now, "$D_{11}$" indicates an outer diameter of the paper-feed roller in its first area; and this outer diameter is measured between two top portions of the micro projections which are formed opposite to each other around the surface of the roller. "$D_{12}$" indicates another outer diameter of the paper-feed roller in its second area. "T" indicates a thickness of the paper; and "H" indicates the height of the micro projection. In addition, "d" indicates a level difference between the level of the top portion of the micro projection, formed in the first area, and the level of the surface of the second area. In general, the paper is carried in a desired direction by being wound about the roller. The distance of feeding the paper with respect to one rotation of the roller can be expressed, using an outer diameter "D" of the roller and the thickness "T" of the paper, by a following expression (1).

$$\pi\,(D+T) \tag{1}$$

The above expression (1) can be used to mathematically express the relationship between the roller and paper under the consideration of the cut-in amount to the paper by the micro projection, as follows:

$$\pi\,(D_{11}+T-2d)=\pi\,(D_{12}+T)$$

Thus, a following equation (2) can be obtained by expanding the above-mentioned mathematical equation with respect to "$D_{12}$".

$$D_{12}=D_{11}-2d \tag{2}$$

In the above equation (2), the value of "d" is set in a range of H>d>0. Incidentally, the value of "d" depends upon the pressure (or load) given by the pinch roller (or rubber roller). In addition, an optimum value selected for "d" is changed in response to the type of the paper material to be used. As the paper material, it is possible to use the plain paper, synthetic paper, coated paper, plastic film, plastic sheet and the like.

Next, the manufacturing process of the paper-feed roller described above will be described. There are provided two kinds of manufacturing processes for the paper-feed roller.

Figure 26A:
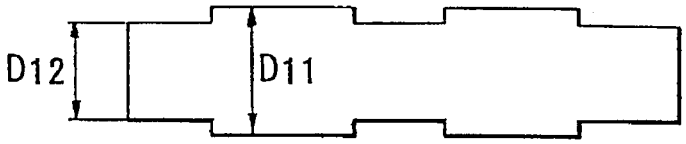
FIGS. 26A, 26B, 26C and 26D are sectional views which are used to explain a first manufacturing process for manufacturing the paper-feed roller.
Figure 26B:
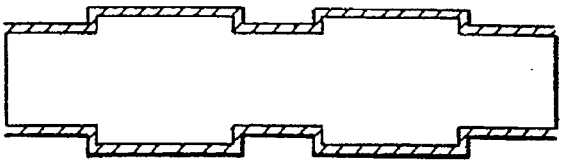
Figure 26C:
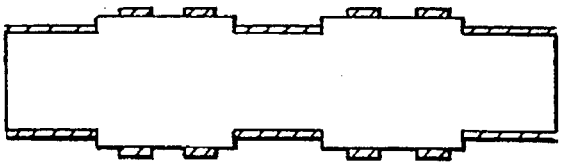
Figure 26D:
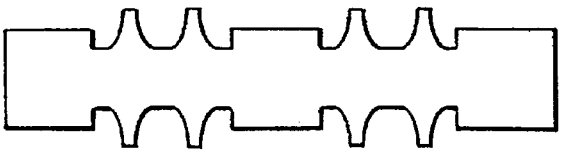

FIGS. 26A to 26D show steps in a first manufacturing process of the paper-feed roller. Herein, symbols $D_{11}$ and $D_{12}$ represent the outer diameters of the base material which is used to manufacture the paper-feed roller. "$D_{11}$" indicates the outer diameter of the paper-feed roller in its first area where the micro projections are to be formed. "$D_{12}$" indicates the outer diameter of the paper-feed roller in its second area where the micro projections are not formed. At first, there is provided a base material, which is made by a metal material such as the stainless steel and carbon steel. In an initial stage before processing the base material, the base material, having a cylindrical shape, has a diameter $D_{11}$. Now, the base material is subjected to cutting process. This cutting process is continuously carried out until the diameter of the base material in the second area, which does not come in contact with the pinch roller, becomes equal to $D_{12}$ as shown in FIG. 26A. After the completion of the cutting process, the resist material is uniformly painted on the surface of the base material as shown in FIG. 26B. Then, a film mask is wound around the base material. This film mask is used to mask the first area, only at the top portions of the micro projections to be formed, as well as the second area in which the micro projections are not formed as shown in FIG. 26C. Then, the base material is subjected to exposure and development. Thereafter, sensitized portions of the resist are removed. Next, the etching process is effected; and then, the remained resist is removed. Thus, the paper-feed roller as shown in FIG. 26D is obtained.

Figure 27A:
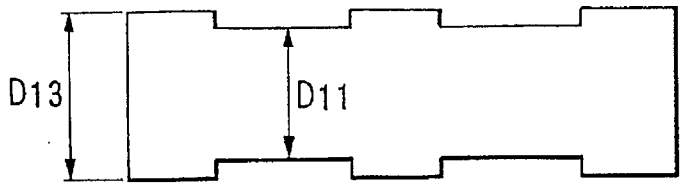
FIGS. 27A, 27B, 27C and 27D are sectional views which are used to explain a second manufacturing process for manufacturing the paper-feed roller.

FIGS. 27A to 27D show steps of a second manufacturing process for the paper-feed roller. In FIG. 27A, "$D_{13}$" is an outer diameter of the base material which will be reduced to "$D_{12}$" by effecting the etching process. Since the micro projection is formed in the height H, the value of "$D_{13}$" can be expressed as follows:

$$D_{13}=D_{12}+2H$$

Figure 27B:
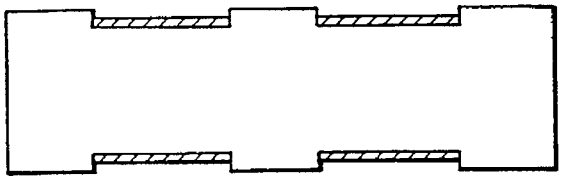
Figure 27C:
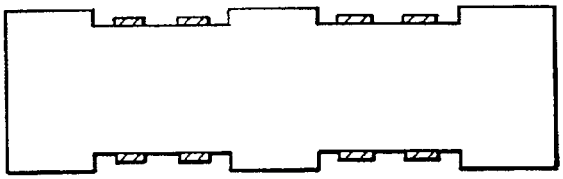
Figure 27D:
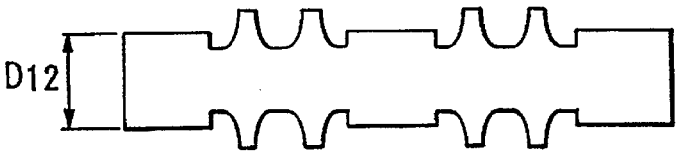

At first, the base material is subjected to cutting process, so that the diameter of the base material at the first area, where the micro projection are to be formed, becomes equal to $D_{11}$ as shown in FIG. 27A. Then, the resist material is painted on the surface of the base material, only at its first area as shown in FIG. 27B. Next, as shown in FIG. 27C, the film mask is wound around the base material, only at the areas where the micro projections are to be formed respectively. Thereafter, the film mask is subjected to exposure and development; and then, the sensitized portions of the resist are removed. Finally, the etching process is performed until the diameter of the base material at its second area where the micro projections are not formed becomes equal to "$D_{12}$". Thus, the paper-feed roller as shown in FIG. 27D is manufactured.

In order to examine the effect of the present embodiment, the applicant has actually manufacture a sample of the paper-feed roller In accordance with the foregoing first manufacturing process. This sample of the paper-feed roller manufactured is compared with the stainless roller with respect to the paper-feed characteristic. The materials of tungsten carbide are sprayed and attached to the surface of the stainless roller.

The stainless round-bar having a length of 360 mm and a diameter of 18 mm is used as the base material for manufacturing the paper-feed roller. In addition, the foregoing diameters shown in FIG. 26A are set such that $D_{11}$ is equal to 17.00 mm and $D_{12}$ is equal to 16.92 mm. As the base material for manufacturing the paper-feed roller, it is possible to use the carbon steel or other general materials of steel, other than the stainless steel. Or, it is possible to use other metal materials which can be etched. Furthermore, it is possible to use soft metal materials or other metal materials whose corrosion resistance is not so high. When using each of those metal materials as the base material, the plating process should be effected on the surface.

The above-mentioned paper-feed roller is manufactured by the steps of process which are shown in FIG. 22.

Particles of tangsten carbide, each having a diameter of 50 μm or less, are sprayed and attached to the surface of the stainless roller.

Figure 28:
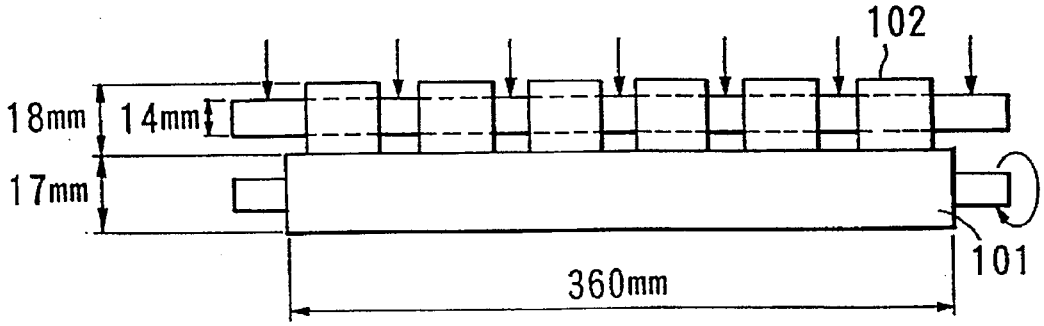
FIG. 28 shows a testing construction for a test to measure a paper-feed characteristic with respect to samples of paper-feed roller.

Thereafter, the paper-feed characteristics of the paper-feed roller and stainless roller are measured and are compared with each other. FIG. 28 is a drawing showing a testing construction between a roller 101 and pinch rollers 102, each of which is made by the rubber material. As the roller 101, the stainless roller or the paper-feed roller manufactured is used. Herein, each pinch roller 102 has an outer diameter of 18 mm. Six rubber members, each of which has a ring-like shape providing a cylindrical bore and each of which has a thickness of 2 mm, are disposed along a metal shaft having a diameter of 14 mm. And, equal distribution of load is provided in such a manner that the same load is imparted to the metal shaft at its seven positions. The total load, which is the sum of the loads applied to the seven positions of the metal shaft, is set equal to 20 kg.

In the testing, a pulse motor (not shown) is driven to rotate the roller by means of a gear or gears (not shown), so that the roller rotates by a certain number of rotation which is set in advance. Then, a paper-feed amount, representing an amount of the paper to be fed by the rotation of the roller, is measured. When measuring the paper-feed amount, a magnifying glass, having a magnification ratio of 50, is used to detect the edge portion of the paper in first and second positions. The edge portion of the paper is located at the first position when the paper is not fed, while the edge portion of the paper is located at the second position when the paper is fed by rotating the roller by the certain number of rotation. Then, a distance between those first and second positions is measured. In the measurement of the paper-feed characteristics of the rollers, a surface-coated paper, having a thickness of 10 μm, is used; and the testing construction is placed in the room in which the temperature is maintained at 20° C. and the humidity is maintained at 40% RH. The results of the measurement are shown in Table 2. Herein, the paper-feed roller manufactured is named as "sample-roller 1", while the stainless roller, on which surface the particles of tangsten carbide are attached, is named as "sample-roller 2".

In Table 2, a paper-feed rate "PFR" is calculated by an equation (3).

$$PFR=PFA1/PFA2=PFA1/\{\pi\ (D_{11}+T)\} \quad (3)$$

Herein, "PFA1" is a paper-feed amount, actually measured, which is obtained by rotating the roller at one time, while "PFA2" is a paper-feed amount which is calculated under the condition where the roller is rotated at one time. A ratio between the paper-feed rate of the sample-roller 1 and the paper-feed rate of the sample-roller 2 is expressed as follows: "0.99758:1.00000". For example, when the A3-size paper is used and the paper-feed amount is set at 400 mm, the value of the above-mentioned ratio indicates that a difference between the paper-feed amounts of the sample-rollers 1 and 2 is about 1 mm.

Next, the paper-feed characteristic is measured again with respect to the sample-roller 1 and the paper-feed roller which is conventionally used and in which the diameter between the top portions of the micro projections is equal to the roller diameter in the second area where the micro projections are not formed. The results of the measurement indicate that no substantial difference can be found between those rollers. However, when the testing is performed by increasing the total load to 40 kg or more, wrinkles are formed on the paper when using the conventional paper-feed roller, whereas no errors in the paper-feed operation is found with respect to the sample-roller 1.

TABLE 2

| Name | Outer diameter | Paper-feed rate | Ratio between paper-feed rates |
|---|---|---|---|
| Sample-roller 1 | 17.00 mm | 0.99579 | 0.99758 |
| Sample-roller 2 | 17.1 mm | 0.99820 | 1.00000 |

TABLE 3

| Item | Optimum range | Preferable range |
|---|---|---|
| Height H | 20 ~ 30 μm | 15 ~ 50 μm |
| Diameter M of top portion | 20 ~ 50 μm | 10 ~ 80 μm |
| Denisty ρ of micro projections | 5 ~ 16/mm$^2$ | 2 ~ 25/mm$^2$ |
| Px | 260 ~ 490 μm | 210 ~ 770 μm |
| Py | 270 ~ 480 μm | 215 ~ 760 μm |
| Δx | 60 ~ 160 μm | 50 ~ 250 μm |
| Δy | 90 ± 30 μm | 90 ± 30 μm |

Next, ideal shape and size of the micro projection, to be formed on the surface of the paper-feed roller, will be studied. Herein, the study is carried out to obtain an optimum height of the micro projection, an optimum diameter of the micro projection at its top portion and an optimum density of the micro projections.

Figure 29:
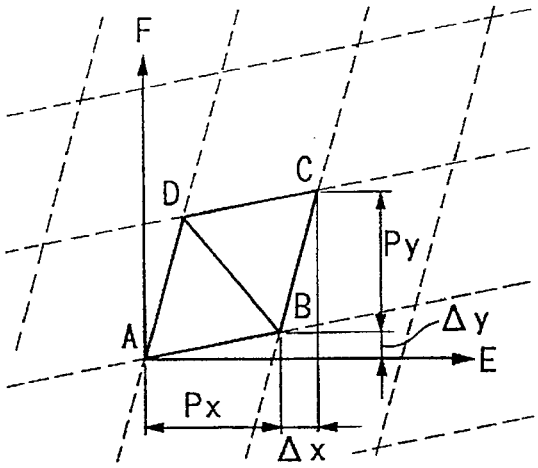
FIG. 29 is a conceptual drawing used for explaining a fundamental pattern for forming the micro projection.

FIG. 29 shows a pattern of the micro projection to be formed on the surface of the paper-feed roller. In FIG. 29, an arrow A-E represents an axis of coordinate corresponding to an axial direction of the paper-feed roller, while an arrow A-F represents another axis of coordinate which crosses with the arrow A-E by a right angle. A, B, C and D indicate points by which the micro projection is to be formed. Px represents a distance between the points A and B on the axis of coordinate A-E; Δx represents a distance between the points B and C on the axis of coordinate A-E; Py represents a distance between the points B and C on the axis of coordinate A-F; and Δy represents a distance between the points A and B on the axis of coordinate A-F.

A pattern for forming the micro projection fundamentally corresponds to a quadrilateral (or parallelogram) which is formed by the points A, B, C and D. This quadrilateral is divided into two triangles ABC and BCD. It is preferable that each of those triangles is made in an equilateral triangle. This ideal is based on the results of the experiments which we have made. The results of the experiments indicate that as the shape of the triangle is deformed more and more from the equilateral triangle, the scratches are formed more easily on the paper, although the density of the micro projections is maintained. The pattern for forming the micro projection can be directly defined by using the distances Px, Δx, Py and Δy.

Now, an optimum range and a preferable range can be determined for each of the items, representing the property of the micro projections, as shown in Table 3. Those ranges are set such that the paper can be carried with accuracy and without forming any scratches on the surface of the paper. As the items, elements H, M and ρ are provided, wherein "H" represents a height of the micro projection, "M" represents a diameter of the top portion of the micro projection and "p" represents a density of the micro projections per unit area (i.e., number of the micro projections formed in one square milli-meters); and the aforementioned elements Px, Δx, Py and Δy are also provided.

Incidentally, it is difficult to select the values for Px, Py, Δx and Δy such that each of the triangles ABD and BCD, which are the fundamental structures for the pattern of the micro projection, is formed in the equilateral triangle. However, it is possible to set each of interior angles of the triangle with in a range between 50° and 80°. It is ideal that a ratio of "Px/Py" is set at "1.0". Actually, however, this ratio can be set in a range between 0.8 and 1.2.

Before filing the present application, we have made a variety of tests to evaluate the values which are selected for each item. In the tests, we have actually manufactured a variety of micro projections with different values for each item. Then, we have measured the critical load, at which the formation of the scratches on the surface of the paper is initiated, coefficients of friction, states of the scratches and paper-feed characteristics.

The results of the measurement for the above-mentioned critical load and coefficient of friction will be described with reference to FIGS. 30 to 37. This measurement is performed on each of the micro projections, which are actually manufactured by changing the height H, diameter M and density ρ.

Figure 30:
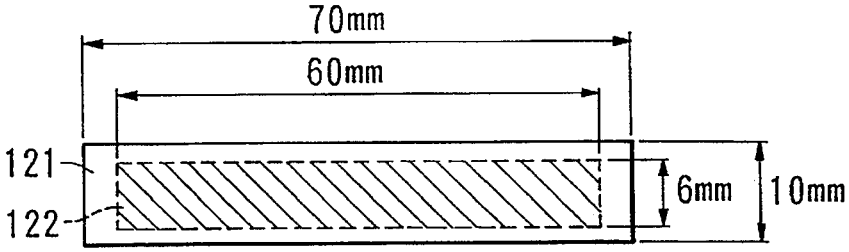
FIG. 30 is a plan view illustrating a stainless flat-plate on which surface the micro projections are formed.
Figure 31:
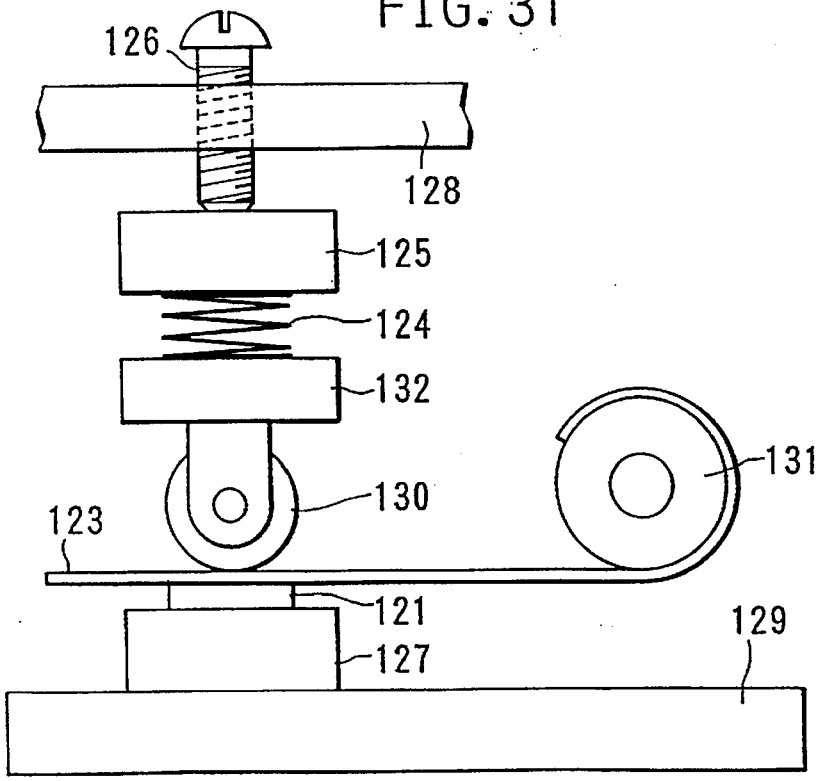
FIG. 31 is a side view illustrating a mechanical structure of a measuring apparatus which measures a variety of elements regarding the paper-feed characteristics with respect to each of different types of micro projections.

FIG. 30 is a plan view showing a stainless flat-plate, which is used for the tests and on which surface the micro projections are formed. Herein, a stainless flat-plate 121 has a lateral length of 10 mm and a longitudinal length of 70 mm. On a area 122, which is arranged on the surface of the stainless flat-plate 121, a variety of micro projections are formed with different values for each item. FIG. 31 is a side view showing a mechanical structure of a measuring apparatus which is used to measure the critical load and coefficient of friction, which may be changed by changing the height H, diameter M and density ρ. In FIG. 31, a pressing mechanism, mainly constructed by a pressing bolt 126, a load cell 125, a spring 124 and a rubber roller 130, is provided to press a paper 123 against the stainless flat-plate 121. The load cell 125 is provided to measure a pressing load given by the pressing bolt 126. A winding roller 131 is connected with a DC motor (not shown) by means of a torque-pickup roller (not shown).

Now, operations of the measuring apparatus will be described; wherein this measuring apparatus is used to measure the pressing load as well as the coefficient of friction which is emerged between the stainless flat-plate 121 and the paper 123. At first, the pressing bolt 126 is released so that the paper 123 is placed between the rubber roller 130 and the stainless flat-plate 121. Then, one edge portion of the paper 123 is wound around the winding roller 131. Next, the pressing bolt 126 is tightened so that a certain load is imparted to the paper 123. At this time, the load is measured by the load cell 125. Thereafter, the DC motor is driven to rotate the winding roller 131 so that the paper 123 is wound up by the winding roller 131. Thus, statical friction force is emerged just before the paper 123 starts to slip on the stainless flat-plate 121; and then, dynamic friction force is emerged in a duration in which the paper 123 slips on the stainless flat-plate 121 at a constant velocity. Each of the statical friction force and dynamic friction force is sensed by the torque-pick-up roller as the torque.

Figure 32:
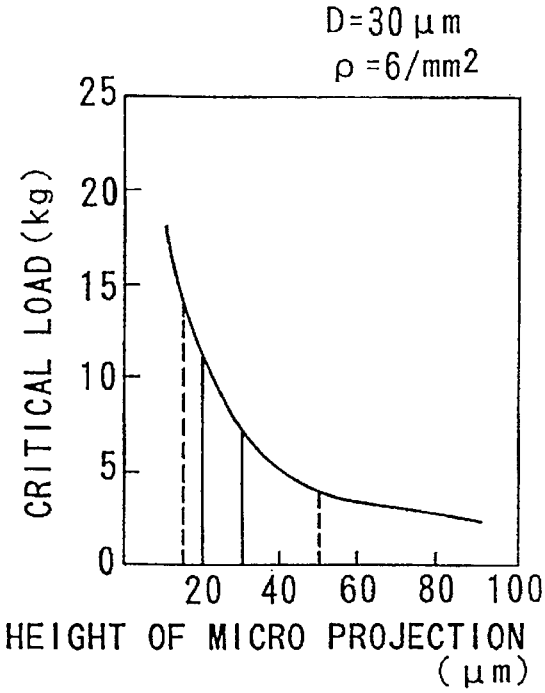
FIGS. 32 and 33 are graphs, each showing a relationship between the height of the micro projection and another factor.
Figure 33:
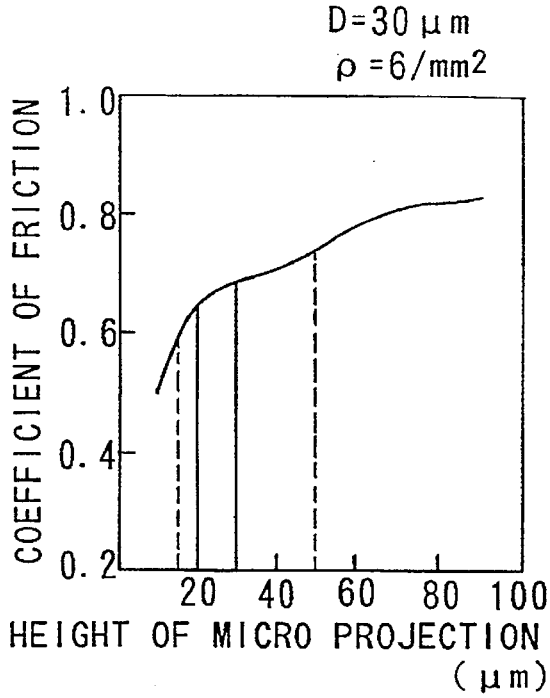
Figure 34:
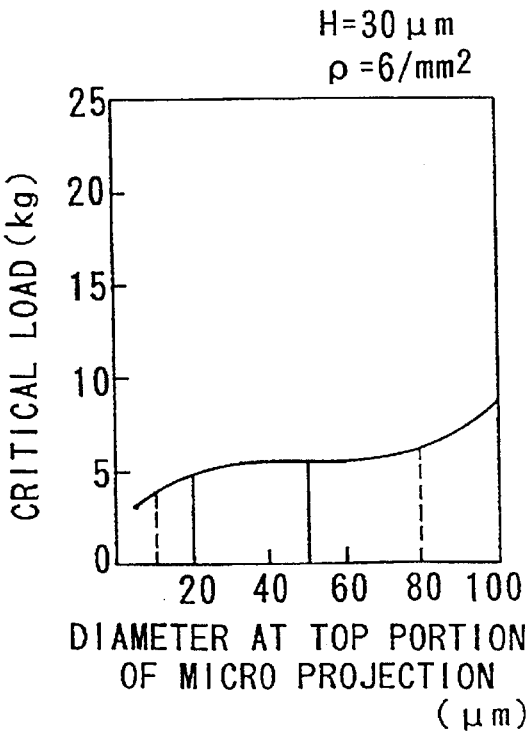
FIGS. 34 and 35 are graphs, each showing a relationship between the diameter at the top portion of the micro projection and another factor.
Figure 35:
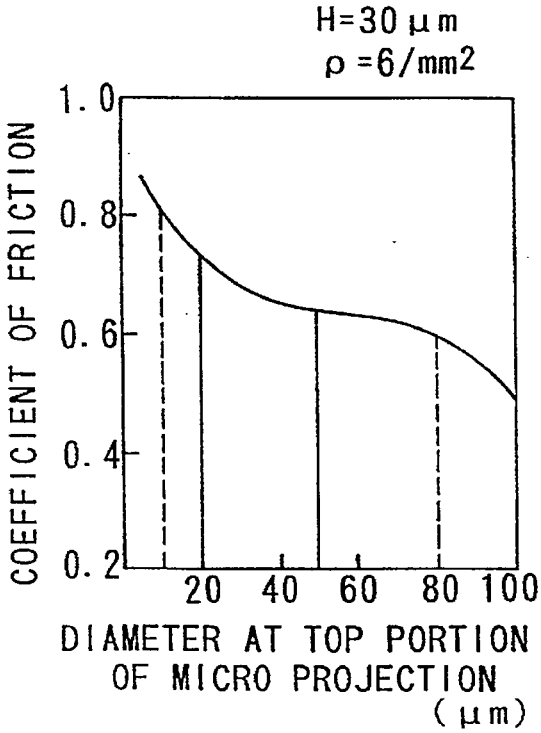
Figure 36:
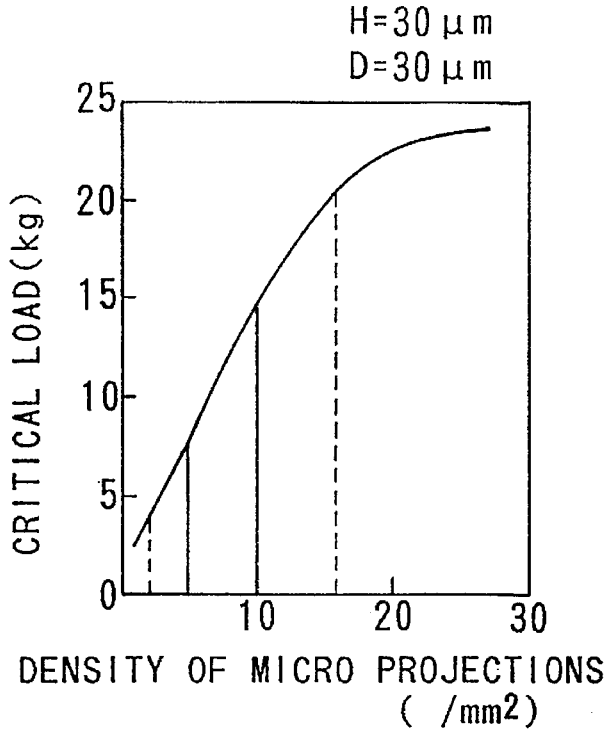
FIGS. 36 and 37 are graphs, each showing a relationship between the density of the micro projections and another factor.
Figure 37:
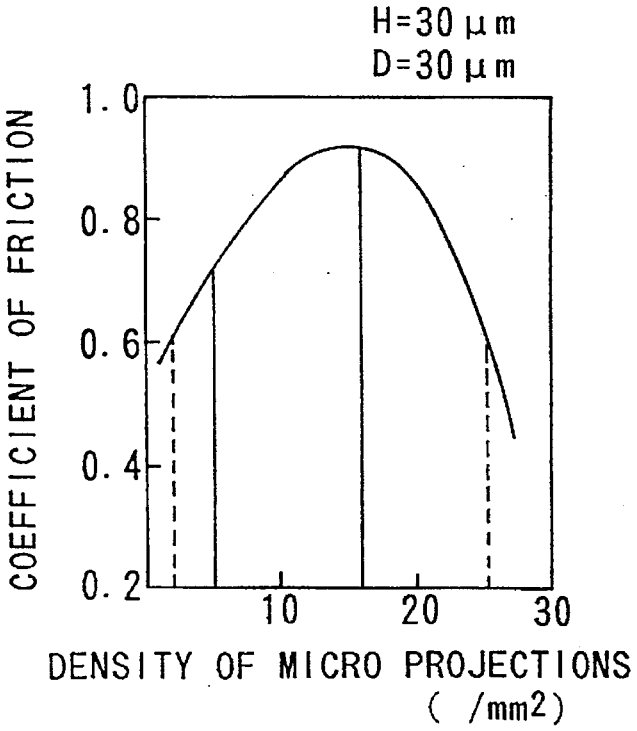

The results of the measurement are shown by FIGS. 32 to 37. FIGS. 32 and 33 are graphs, each showing a relationship between the height of the micro projection and another element (i.e., the critical load, at which the formation of the scratches on the surface of the paper is initiated, and the coefficient of friction). Herein, the height of the micro projection is altered, while other elements are set constant. Namely, the diameter M at the top portion of the micro projection is set at 30 μm and the density ρ of the micro projections is set at 6/mm$^2$. The critical load is measured in the unit of "Kg". FIGS. 34 and 35 are graphs, each showing a relationship between the diameter at the top portion of the micro projection and another element. Herein, the diameter M is altered, while the height H is constantly set at 30 μm and the density ρ is constantly set at 6/mm$^2$. FIGS. 36 and 37 are graphs, each showing a relationship between the density of the micro projections and another element. Herein, the density ρ is altered, while the height H is constantly set at 30 μm and the diameter M is constantly set at 30 μm.

The contents read from those graphs can be summarized as described below with respect to each of the height H, diameter M and density ρ.

(1) Height of micro projection

It is ideal that the paper-feed roller providing the micro projections offers a large coefficient of friction but does not contribute to the formation of the scratches on the surface of the paper. In order to realize the above-mentioned ideal factors in the paper-feed roller, the height of the micro projection should be limited by the critical load. An upper limit for the critical load is 4 Kg. Thus, it can be read from the graph shown in FIG. 32 that an upper limit for the height of the micro projection is 50 μm. On the other hand, a lower limit for the height of the micro projection responds to the coefficient of friction. A practical lower limit for the coefficient of friction is 0.6. Thus, it can be read from the graph shown in FIG. 33 that the lower limit for the height of the micro projection is 15 μm. However, the upper and lower limits for the height of the micro projection are changed in response to a variation in the diameter and density as well as a change in the arrangement of the micro projections. By considering those variation and change, we have reached a conclusion that an optimum range between 20 μm and 30 μm is selected for the height of the micro projection. Those values perfectly match with the values of the optimum range and preferable range described in Table 3. In short, it can be said that the ranges described in Table 3 in connection with the height H are appropriate.

(2) Diameter at top portion of micro projection

An upper limit for the diameter at the top portion of the micro projection is determined by the coefficient of friction. In other words, a practical lower limit for the coefficient of friction is 0.6; thus, it can be read from the graph shown in FIG. 35 that the upper limit for the diameter is 80 μm. In addition, a lower limit for the diameter is determined by the critical load. Namely, the practical upper limit for the critical load is 4 Kg; thus, it can be read from the graph shown in FIG. 34 that the lower limit for the diameter is 10 μm. Under the consideration a relationship between the height of the micro projection and the density of the micro projections, an optimum range between 20 μm and 30 μm can be selected for the diameter at the top portion of the micro projection. Those values perfectly match with the values in the optimum range and preferable range described in Table 3. In short, it can be said that the ranges for the diameter M, described in Table 3, are appropriate.

(3) Density of micro projections

An upper limit for the density of the micro projections is also determined by the coefficient of friction. Since the practical lower limit for the coefficient of friction is 0.6, the graph of FIG. 37 shows that the upper limit for the density of the micro projections is $20/mm^2$. In addition, a lower limit for the density of the micro projections is determined by the critical load. Since the practical upper limit for the critical load is 4 Kg, the graph of FIG. 36 shows that the lower limit for the density of the micro projections is $2/mm^2$. Under the consideration of a relationship between the height and diameter of the micro projection, an optimum range between $5/mm^2$ and $16/mm^2$ can be selected for the density of the micro projections. Those values perfectly match with the values of the optimum range and preferable range described in Table 3. In short, it can be said that the values described in Table 3 in connection with the density ρ are appropriate.

Next, in order to evaluate the values described in Table 3, we have actually manufactured four types of sample-rollers 3 to 6, each having a different pattern of forming the micro projection. Then, we have measured the states of the scratches to be formed on the surface of the paper as well as the paper-feed characteristic. Each of the sample-rollers 3 to 6 is manufactured from the same base material which is the stainless round-bar having a diameter of 18 mm and a length of 360 mm.

The results of the measurement are shown in Table 4. Further, the evaluation of the states of the scratches and the paper-feed characteristics is performed by actually equipping each sample-roller in the thermal-transfer-type color printer in which the paper is carried forward and backward three times. The results of the evaluation is shown in Table 5.

TABLE 4

| Name | sample roller 3 | sample roller 4 | sample roller 5 | sample roller 6 |
|---|---|---|---|---|
| Height H (μm) | 30 | 160 | 30 | 10 |
| Diameter M (μm) | 30 | 30 | 30 | 30 |
| Density ρ ($/mm^2$) | 8.4 | 8.4 | 1 | 8.4 |
| Px (μm) | 360 | 360 | 990 | 360 |
| Py (μm) | 360 | 360 | 990 | 360 |

TABLE 4-continued

| Name | sample roller 3 | sample roller 4 | sample roller 5 | sample roller 6 |
|---|---|---|---|---|
| Δx (μm) | 120 | 120 | 330 | 120 |
| Δy (μm) | 90 | 90 | 90 | 90 |

TABLE 5

| Name | sample roller 3 | sample roller 4 | sample roller 5 | sample roller 6 |
|---|---|---|---|---|
| State of scratches | good | not good | not good | good |
| paper-feed characteristic | good | good | not good | good |

The results of the evaluation may support the validity of the values of the optimum range and preferable range which are described in Table 3 with respect to Px, Py, Δx and Δy.

The evaluation is carried out with respect to the height and diameter of the micro projection, density of the micro projections and the pattern of forming the micro projection under the condition where the micro projection is formed through the etching process. However, the same results of the evaluation can be obtained with respect to the micro projection which is formed by the plating process or the like. Moreover, the shape of the top portion of the micro projection is not limited to the circular shape. Even if the top portion of the micro projection employs a specific shape other than the circular shape, the specific shape can be roughly converted into an equivalent circular shape having a radium R which is expressed by an equation (4).

$$R=(4\times SSA/\pi)^{-1/2} \quad (4)$$

Herein, "SSA" represents a surface area of the top portion of the micro projection, which has the specific shape other than the circular shape. This equation (4) is obtained from an equation (5) wherein "CSA" represents a surface area, having a circular shape, of the top portion of the micro projection and "M" represents a diameter of the circular shape.

$$CSA=\pi\cdot M^2/4 \quad (5)$$

Lastly, this invention may be practiced or embodied in still other ways without departing from the spirit or essential character thereof as described heretofore. Therefore, the preferred embodiments described herein are illustrative and not restrictive, the scope of the invention being indicated by the appended claims and all variations which come within the meaning of the claims are intended to be embraced therein.

What is claimed is:

1. A thermal-transfer-type color printer for a sheet member comprising:

a thermal head;

a platen roller located to face said thermal head, said platen roller being rotatable in a direction in accordance with a carrying movement of a sheet member passing thereof;

a sheet member feed roller whose outer surface is formed as part of the material of the sheet member feed roller with integral micro projections of a predetermined shape over which the sheet member travels, said sheet member feed roller spaced apart from said platen roller and located along a carrying direction of the sheet member, said sheet member feed roller being driven to rotate to carry the sheet member with said platen roller being rotated by the sheet member as it is moved by said sheet member feed roller;

an ink ribbon having a surface on which a plurality of colors of ink are painted in defined bands, said ink ribbon being pressed against the sheet member by being sandwiched between said thermal head and said platen roller to transfer the colors of ink onto the sheet member in accordance with print data; and control means operable in a printing mode of the printer for controlling rotatable movement of said platen roller at a speed of rotation slower than the speed of rotation of said sheet member feed roller to establish a predetermined amount of tension on the sheet member between said platen roller and said sheet member feed roller.

2. A thermal-transfer-type color printer as in claim 1 wherein the density, height and free end diameter of the micro projections are selected to produce a coefficient of friction of at least 0.6 with respect to the sheet member moving thereover.

3. A paper-feed mechanism for a thermal-transfer-type color printer, comprising:

a sheet member feed roller having an outer surface etched with integral micro projections of predetermined shape formed over the entirety of its outer surface over which the sheet member passes;

a shaft spaced from said sheet member feed roller by a predetermined distance;

at least one holding member attached to said shaft projecting toward said sheet member feed roller;

a plurality of rollers mounted for free rotation on said holding member along a direction transverse to the movement of the sheet member and at a plurality of points across substantially the entire dimension of the sheet member transverse to the direction of movement of the sheet member; and pressing means for pressing said plurality of freely rotatable rollers toward said sheet member feed roller to engage the sheet member across the entirety of its dimension transverse to the direction of sheet member movement.

4. A sheet member feed mechanism for a thermal-transfer-type color printer, comprising:

a pinch roller; and a sheet member feed roller located facing said pinch roller in a printing mode with a sheet member sandwiched between the pinch roller and the sheet member feed roller being moved forward and backward, wherein the outer surface of said feed roller is formed with etched integral micro projections of a predetermined shape in a predetermined pattern over the area on which the sheet member travels, said etched micro projections being of different sizes and the free ends of said projections all extending from said feed roller by the same distance and selectively being of different sizes.

5. A sheet member feed mechanism for a thermal-transfer-type color printer, comprising:

a pinch roller; and a sheet member feed roller located facing said pinch roller in a printing mode with a sheet member sandwiched between the pinch roller and the sheet member feed roller, the outer surface of the sheet member feed roller over which the sheet member passes being divided into first and second areas, wherein only the second area comes in contact with the pinch roller in the printing mode, and said sheet feed roller has integral micro projections of predetermined shape etched on its outer surface only in said second area.

6. A sheet member feed mechanism as defined in claim 5 wherein the micro projections re formed in height, diameter and density determined to prevent a pressed recess or a hole from being formed on the sheet member and to produce a sufficient friction force to hold the sheet member.

7. A thermal-transfer-type printer as in claim 5 wherein each of said first and second areas of said sheet member feed roller is a defined continuous segment of the roller outer surface.

8. A sheet member feed mechanism for a thermal-transfer-type color printer, comprising:

a pinch roller; and a sheet member feed roller located facing said pinch roller in a printing mode with a sheet member sandwiched between the pinch roller and the sheet member feed roller, the outer surface of the sheet member feed roller over which the sheet member passes being divided into first and second areas, wherein only the second area comes in contact with the pinch roller in the printing mode, and integral micro projections of predetermined shape formed on the outer surface of said sheet member feed roller in the second area only wherein a first outer diameter of the sheet member feed roller in said first area, in which the micro projections are not formed, is smaller than a second diameter of the sheet member feed roller in said second area, which is measured between the top ends of two micro projections located diametrically opposite to each other on the sheet member feed roller but is larger than a third diameter of the sheet member feed roller in said second area, which is measured between bottom portions of the two micro projections located diametrically opposite to each other.

* * * * *